US010488143B2

(12) United States Patent
Victor et al.

(10) Patent No.: US 10,488,143 B2
(45) Date of Patent: Nov. 26, 2019

(54) RAPID FIRE TOY LAUNCH APPARATUS

(71) Applicant: Hasbro, Inc., Pawtucket, RI (US)

(72) Inventors: Robert James Victor, New York, NY (US); Christopher David Miller, Tarrytown, NY (US); Angela Yuan, New York, NY (US); John Michael Falkowski, II, Kingston, MA (US); John Paul Lallier, North Attleboro, MA (US); Daniel King, Palmer, MA (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 16/105,546

(22) Filed: Aug. 20, 2018

(65) Prior Publication Data

US 2019/0063865 A1 Feb. 28, 2019

Related U.S. Application Data

(60) Provisional application No. 62/551,693, filed on Aug. 29, 2017.

(51) Int. Cl.

| | |
|---|---|
| ***F41B 4/00*** | (2006.01) |
| ***F41A 9/66*** | (2006.01) |
| ***A63F 9/02*** | (2006.01) |
| ***F41A 9/83*** | (2006.01) |

(52) U.S. Cl.

CPC ..... *F41B 4/00* (2013.01); *A63F 9/0252* (2013.01); *F41A 9/66* (2013.01); *F41A 9/83* (2013.01)

(58) Field of Classification Search

CPC ..... F41B 4/00; F41A 9/00; F41A 9/66; F41A 9/82; F41A 9/83; A63F 9/0252

USPC ..... 124/31, 45, 78

See application file for complete search history.

(56) References Cited

U.S. PATENT DOCUMENTS

| | | | | |
|---|---|---|---|---|
| 2,737,942 A | | 3/1956 | Horowitz et al. | |
| 2,783,570 A | * | 3/1957 | Kunz | F41A 9/66 42/18 |
| 2,908,097 A | * | 10/1959 | Allyn | F41A 9/66 42/18 |

(Continued)

FOREIGN PATENT DOCUMENTS

| | | |
|---|---|---|
| CH | 128249 A | 10/1928 |
| CN | 204177283 U | 2/2015 |

(Continued)

OTHER PUBLICATIONS

European Patent Application No. 18191106.6—Communication with European Search Report, dated Dec. 4, 2018.

*Primary Examiner* — Alexander R Niconovich

(74) *Attorney, Agent, or Firm* — Perry Hoffman

(57) ABSTRACT

Apparatus and methods employing projectile feeding magazine storage and rapid fire toy launch apparatus in combination with dart funnel for feeding darts, anti-jamming loading and launching mechanisms, receiving a series of dart projectiles for rapid magazine loading and firing without mis-fed darts jamming up either the dart magazine or launcher. A magazine loading mechanism is positioned intermediate the funnel and the inserted magazine for receiving darts, and a stuffer mechanism above the inserted magazine penetrates the dart retaining lips of the magazine to stuff darts for loading into the magazine. The dart launching mechanism is positioned in the housing forward the inserted magazine.

20 Claims, 18 Drawing Sheets

(56) References Cited

U.S. PATENT DOCUMENTS 3,990,426 A 11/1976 Stokes
4,841,945 A 6/1989 Braden
4,890,404 A * 1/1990 Ferri ..... F41C 3/12 124/2
5,471,967 A * 12/1995 Matsuzaki ..... F41B 4/00 124/47
5,669,171 A * 9/1997 Sally ..... F41A 9/66 42/60
6,220,237 B1 * 4/2001 Johnson ..... F41B 11/641 124/60
6,408,837 B1 * 6/2002 Johnson ..... F41B 11/681 124/51.1
6,488,019 B2 * 12/2002 Kotsiopoulos ..... F41B 11/57 124/48
7,051,727 B2 * 5/2006 Wu ..... F41B 4/00 124/6
8,082,909 B2 * 12/2011 Sopinsky ..... A63F 9/02 124/16
8,353,277 B2 * 1/2013 Huebl ..... F41A 9/26 124/48
8,484,874 B2 * 7/2013 Kim ..... F41A 9/66 42/49.01
8,695,579 B2 4/2014 Huebl
9,027,541 B2 * 5/2015 Huebl ..... F41B 11/54 124/48
9,429,385 B1 * 8/2016 Allen ..... F41B 11/54
9,958,230 B1 * 5/2018 Nugent ..... F41B 4/00
2002/0166551 A1 * 11/2002 Lee ..... F41B 4/00 124/78
2009/0095272 A1 4/2009 Zimmerman
2011/0041823 A1 * 2/2011 Victor ..... F41B 4/00 124/48
2013/0112184 A1 * 5/2013 Corsiglia ..... F42B 6/00 124/78
2013/0312722 A1 11/2013 Price
2013/0312726 A1 * 11/2013 Mead ..... F41A 9/26 124/78
2018/0321004 A1 * 11/2018 Fausti ..... F41A 9/61

FOREIGN PATENT DOCUMENTS

DE 554199 C1 7/1932
GB 274115 A 5/1928
GB 382142 A 10/1932

* cited by examiner

RAPID FIRE TOY LAUNCH APPARATUS

PRIORITY CROSS-REFERENCE TO RELATED APPLICATION

This application claims priority pursuant to 35 U.S.C. 119(e) from U.S. Provisional Patent Application, No. 62/551,693 filed on Aug. 29, 2017.

FIELD OF THE INVENTION

The present invention relates to toy projectile launchers and more particularly, to a rapid fire toy launch apparatus employing projectile feeding magazine storage, anti-jamming loading and launching mechanisms including a dart feeding magazine combination with a dart funnel. A loading mechanism may be positioned at the open end of an inserted magazine with a stuffer mechanism that penetrates a dart magazine receiving a series of dart projectiles for rapidly loading into the magazine and firing from the apparatus without mis-fed darts jamming up either the dart magazine or launcher.

BACKGROUND OF THE INVENTION

Projectile launchers/shooting mechanisms are well known in the art and include mechanisms for launching toy darts, balls of various sizes, paint balls, etc., and even paper money. Various toy launchers/guns known in the art employ a projectile shooting mechanism made up of two opposed rotatable wheels (known as a drive or fly wheels) which engage a dart or other various balls and projectiles there between. A motor drives rotation of one or both wheels creating a launching force frictionally applied to the dart/projectile as the dart/projectile engages a wheel surface on each of the opposed rotatable wheels. The rotating wheels impart sufficient energy to the dart/projectile to launch the dart/projectile from the gun/shooter or hopper.

Some known methods/mechanisms for feeding darts into a drive or fly wheel or other energized launching mechanism includes advancing mechanisms actively pushing darts or projectiles into an energized launching mechanism or, alternatively, mechanisms which remove physical barriers from a path or channel leading to a launching mechanism. Various known feeding mechanisms employ rods, pistons or hammers which actively push darts into an adjacent launching mechanism. Feeding mechanisms are known to include an elongated arm biased into contact with a stack of darts lined up adjacent a drive wheel. The arm is biased into contact with the upper most dart of the stack and urges the lower most dart into the barrel adjacent the drive wheel. A biased trigger and hammer arrangement push the dart through the barrel and into the drive wheel for firing the dart when the trigger is pulled.

Also known is a trigger lever which rotates when pulled, translating into movement of a bullet pusher to advance a bullet toward rotating projector wheels which then fire the bullet. The bullet pusher can be motorized to advance bullets faster as the trigger can activate a motor to drive the bullet pusher in a reciprocating manner firing bullets in a rapid fire manner. Other known feeding mechanisms remove physical barriers from a path leading to a launching mechanism and are known to include a biased trigger, that when depressed, removes a barrier and allows a dart or projectile to enter a launch channel for engagement with rotating flywheels or drive wheels to project the dart.

Other known mechanisms utilize a belt surface to elevate or transport projectiles or balls to a launching mechanism or to shoot projectiles such as paper money from a gun. It is known to employ a belt surface with multiple holders that separate the belt surface into compartments so as to carry multiple balls, each ball in its own individual compartment, along the belt surface from a hopper to the launching mechanism. This individual arrangement of balls on the belt surface allows for the feeding of only one ball at a time into the launcher mechanism, even though multiple balls travel together from the hopper to the launcher mechanism. Also, it is known to dispose a conveyer belt between two conveyor belt drive wheels and dispose a stack of paper currency onto a surface of the belt. Movement of the belt forces sheets of paper currency out a currency exit slot of a gun. Additionally, it is known to secure darts to a belt surface, by storing each dart in its own bracket on the belt. The belt travels through a launcher housing where motorized flywheels lift each dart from its storage compartment and launch each dart from the housing.

Significantly, known toy launchers do not include a funnel feeding magazine loading mechanism using a pathway and a stuffer that penetrates a dart magazine feeding darts for rapidly firing darts from the toy apparatus for hassle-free dart feeding, magazine loading and firing from the launcher. It is found desirable to provide a dart funnel on the housing assembly for at least one dart manually fed into the funnel to reliably load each dart while at the same time employing magazine loading, stuffer, and dart launching mechanisms continually with a stuffer mechanism above the magazine for penetrating therein and stuff retained dart for loading into the magazine; the inserted magazine receiving a series of darts loaded into the dart magazine and thereafter advancing darts to a dart launching mechanism.

SUMMARY OF THE INVENTION

The present invention addresses shortcomings of the prior art to provide a toy launch apparatus which extends a feeding/anti-jamming mechanism into a dart magazine releasing and feeding darts into an energy generating mechanism for rapid fire launching of darts from the apparatus with release and advancement of darts from the magazine into the energy generating mechanism to significantly reduce the incidence of darts jamming up in the toy launch apparatus. A dart funnel is provided on the housing assembly for a series of darts manually fed into the funnel, a dart magazine inserted into the housing assembly provides an open end including dart retaining lips at the open end where a biased dart advancing mechanism urges darts in the dart magazine toward the open end of the dart magazine, each dart having a sidewall, a forward tip and a rear advancing surface, the biased dart advancing mechanism in the dart magazine urging darts therein at the dart sidewall.

In one embodiment of the invention, the toy launch apparatus includes a housing assembly, a funnel and a dart magazine inserted into the housing assembly and having an open end and including retaining lips at the open end, one or more darts loaded into the dart magazine. A magazine loading mechanism positioned in the housing intermediate the funnel and the dart retaining lips at the open end of the inserted magazine for receiving the at least one dart from the funnel for loading at the open end of the inserted magazine, an energy generating mechanism is in communication with the feeding mechanism, and a dart launching mechanism in the housing forward the inserted magazine with at least one energy generating mechanism in communication with each of the magazine loading and dart launching mechanisms. A further stuffer mechanism is coupled to the housing above the inserted magazine for penetrating therein stuffs at least one dart at the dart sidewall from between the dart retaining lips for loading into the magazine, the inserted magazine receiving a series of darts loaded into the dart magazine.

BRIEF DESCRIPTION OF THE DRAWINGS

For the purpose of facilitating an understanding of the inventions, the accompanying drawings and description illustrate preferred embodiments thereof, from which the inventions, structure, construction and operation, and many related advantages may be readily understood and appreciated.

FIG. 3D illustrates retaining lips structures at an open end of a dart magazine clip, while

DETAILED DESCRIPTION OF THE EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Figure 1:
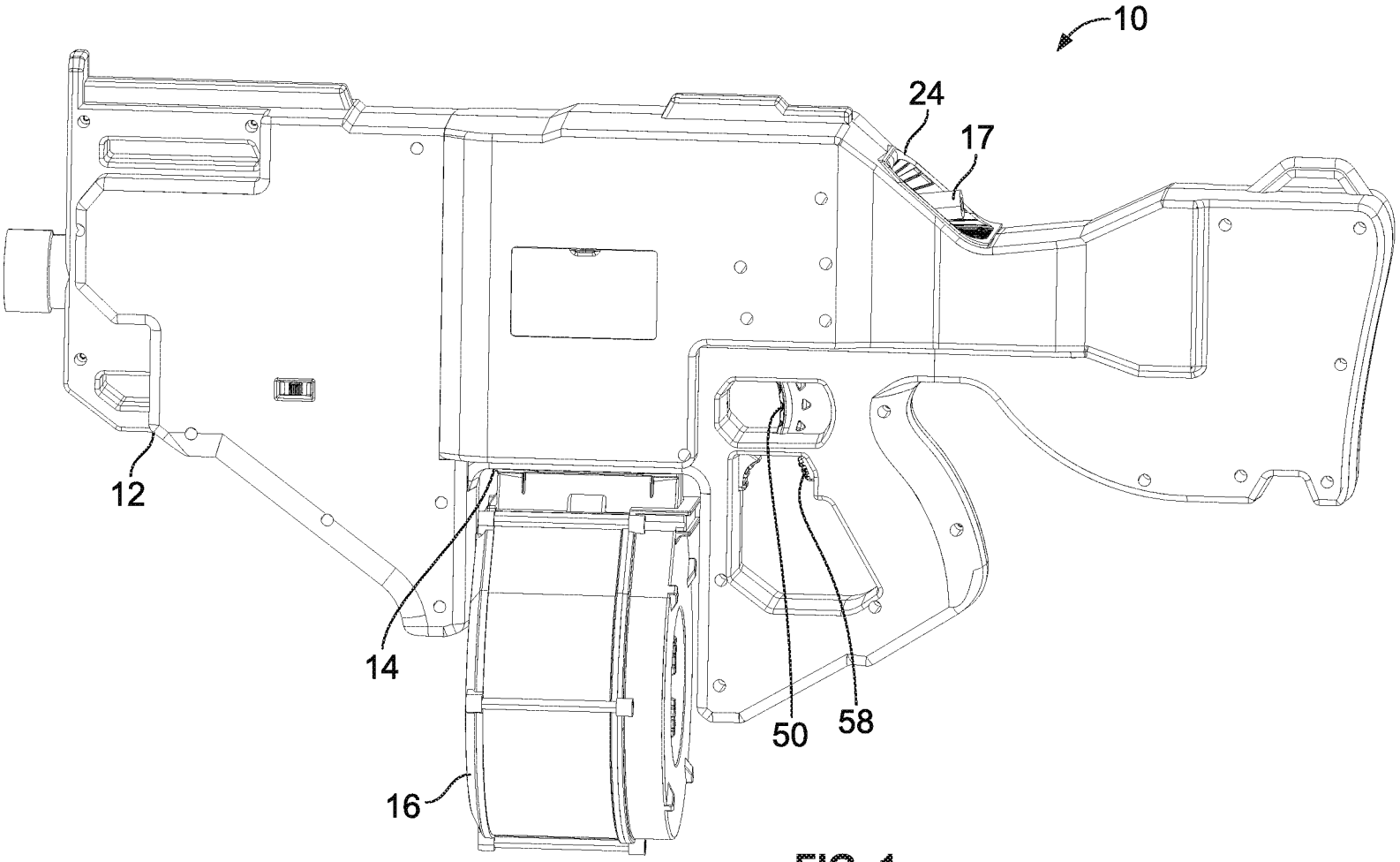
FIG. 1 is a perspective view of a toy launch apparatus with a dart magazine inserted into the housing assembly positioned with the launch apparatus including dart magazine loading structures and related mechanisms in the housing in accordance with the present invention.

A toy launch apparatus 10, as seen in FIG. 1, is generally seen to simulate the shape of a gun and includes a rapid fire toy launch apparatus employing projectile feeding magazine storage, anti-jamming loading and launching mechanisms including a dart feeding magazine combination with a dart funnel 24 for at least one dart manually fed into the funnel. Once the dart 17 is in the launch apparatus 10 it is pulled into a loading sequence which will push the dart into the magazine. The loading mechanism may be positioned at the open end of an inserted magazine with a stuffer mechanism that penetrates a dart magazine receiving a series of dart projectiles for rapidly loading into the magazine and firing from the apparatus without mis-fed darts jamming up either the dart magazine or launcher structures. The launch apparatus 10 includes a housing assembly 12 generally shaped like as a toy blaster or dart launcher which includes a loading slot 14 into which a dart magazine 16 is inserted, as seen in FIG. 1. The described apparatus and methods facilitate rapidly receiving toy projectiles, storage with firing toy projectile loading and launch structures employing a feeding/magazine storage mechanism including a simple and nearly continuous dart feeding magazine receiving each dart into and from the magazine storage further employing launch elements advancing projectiles into an energy generating mechanism for rapidly firing darts from the toy apparatus. While the dart magazine 16 or drum is removable from the launch apparatus 10 includes a housing assembly 12, this load feature is achieved as loading darts to the apparatus 10 without having to remove the dart magazine 16.

Figure 2:
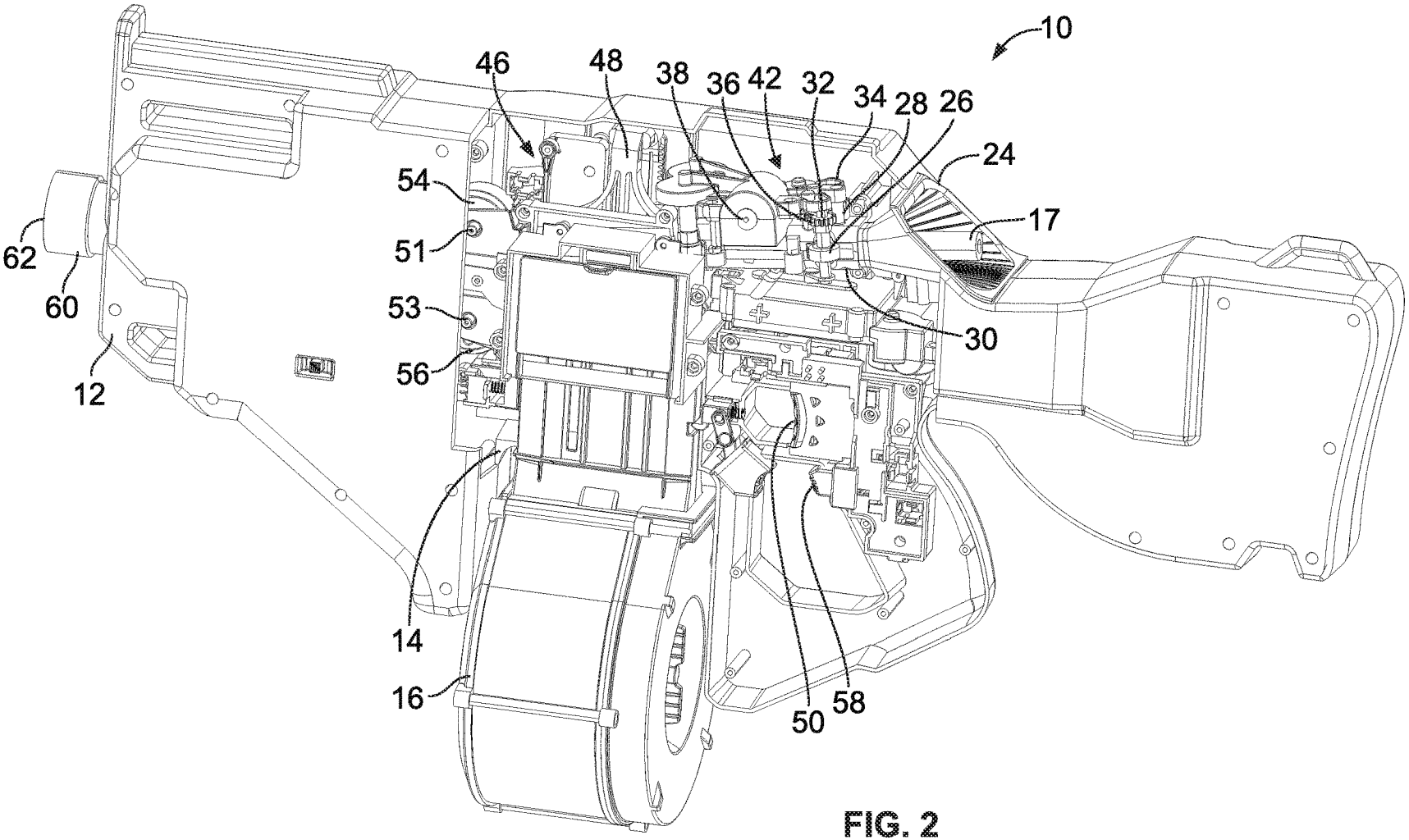
FIG. 2 is a further perspective view of apparatus of the present invention viewing the launch apparatus with parts broken away to illustrate a dart funnel on the housing assembly for projectiles manually fed into the funnel, with magazine loading, stuffer, and dart launching mechanisms, with FIG. 3A viewing the feeding/magazine storage mechanism from a slightly different angle than FIG. 2 illustrating simple and nearly continuous dart magazine loading and following structure for firing projectiles from the magazine thereof.
Figure 3A:
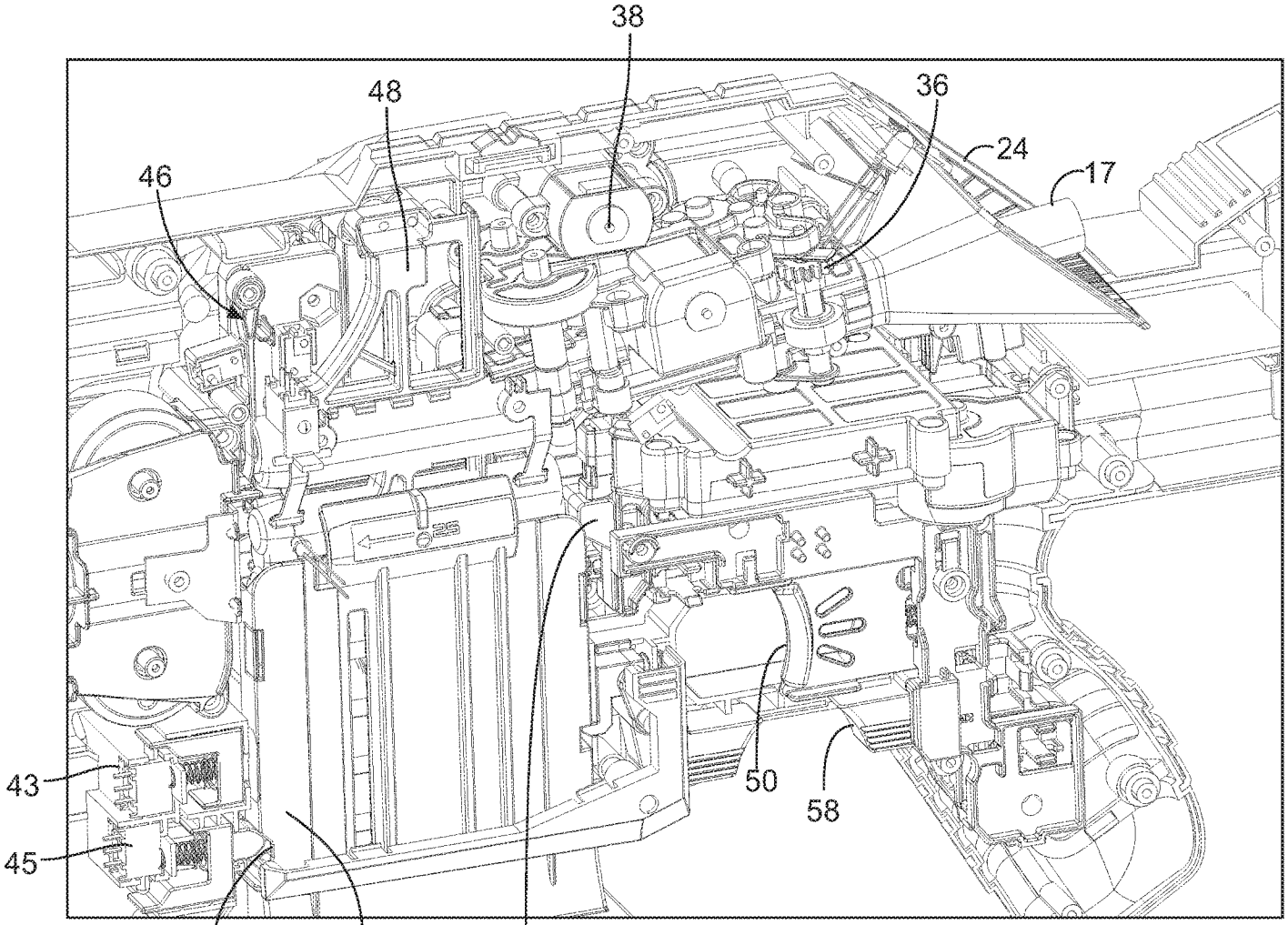
Figure 3B:
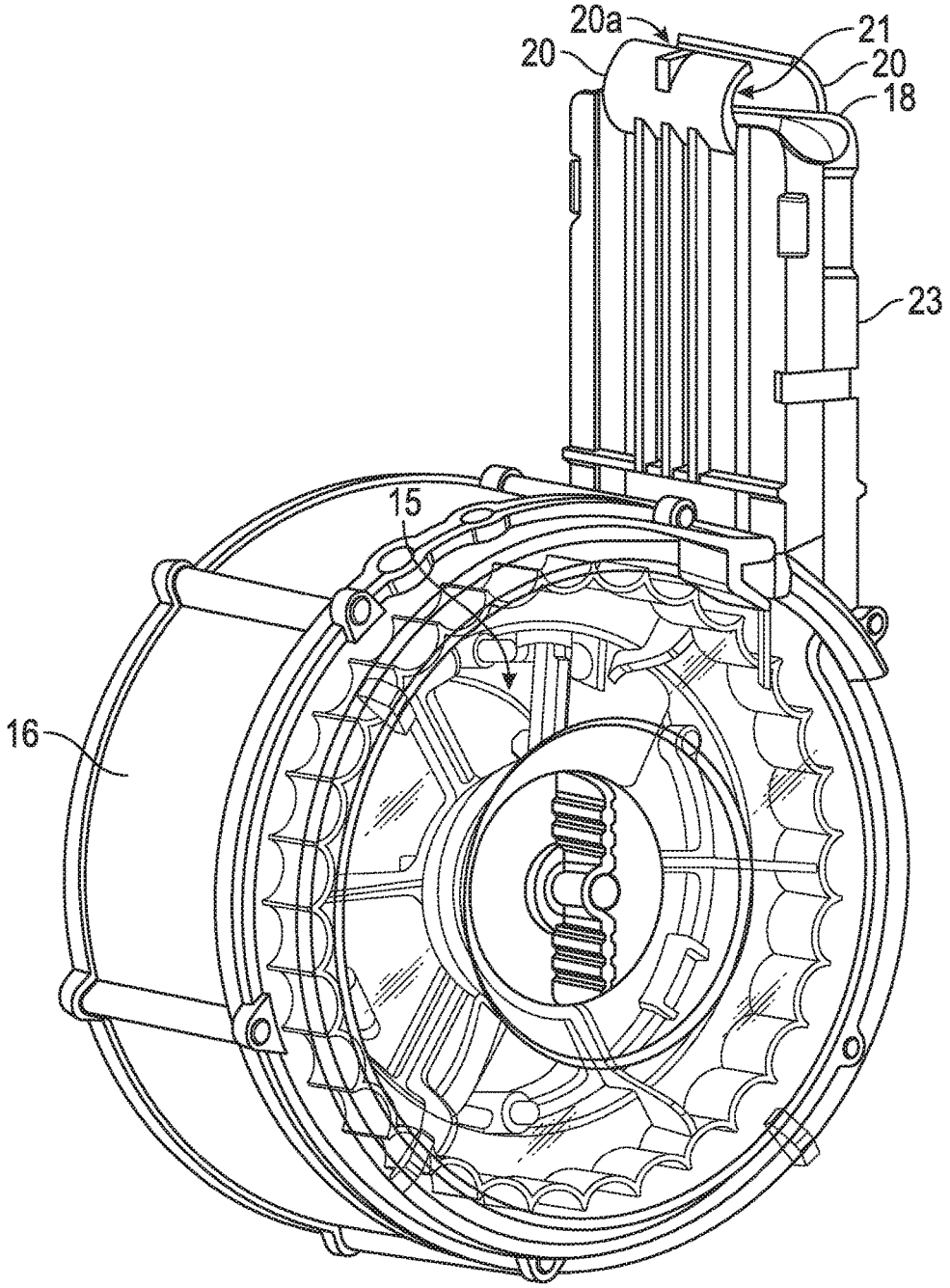
FIG. 3B shows a drum gun magazine for use with the toy launch apparatus.
Figure 3C:
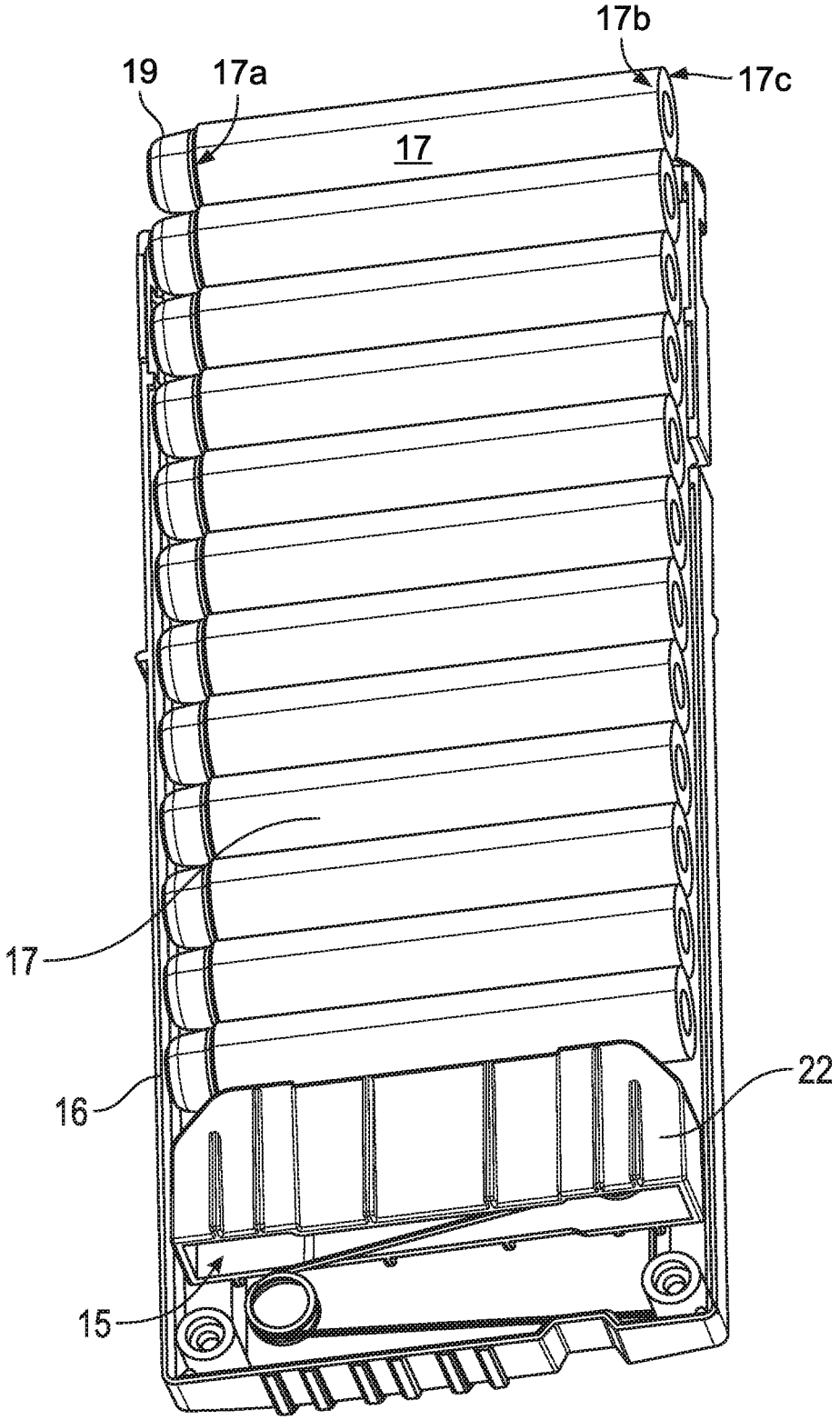
FIG. 3C shows a clip gun magazine including a dart advancing mechanism at a magazine clip for advancing darts into the toy launch apparatus, with a biased dart advancing mechanism urging darts in the dart magazine toward the open end of the dart magazine, each dart having a sidewall, a forward tip and a rear advancing surface, the biased dart advancing mechanism in the dart magazine urging darts therein at the dart sidewall.

The dart magazine 16, as shown in FIGS. 1-3B, includes a machine gun type magazine holding 30 or so darts 17, but can also include a straight rectangular magazine holding 6-18 darts 17, etc., as seen in FIG. 3C. As discussed further, each dart 17 has a sidewall, a forward tip 19, a first end 17*a*, a second end 17*b*, and a rear advancing surface 17*c*. Additionally, other variations of known dart magazines designed to snap into the slot 14 of the housing assembly 12 and advance darts into the toy launch apparatus 10 are contemplated.

The machine gun type dart magazine 16 holds 30 or more darts in a circular drum and advances retained darts to an open end 18, as seen in FIG. 3B. A straight rectangular portion 23, extends from the circular drum and includes the open end 18 for fitting the machine gun magazine into the slot 14 of the toy launch apparatus 10. Similarly, the dart magazine 16 which holds a various number of darts from 6-18, as seen in FIG. 3C, is entirely straight and generally rectangular in shape 16 and also advances retained darts 17 toward the open end 18. The rectangular magazine 16, as seen in FIG. 3C, is interchangeable with the machine gun magazine and also snaps into slot 14 of the toy launch apparatus 10 at the open end 18 of the magazine. A dart advancing mechanism 15 within the magazine creates a force to bias the retained darts 17 toward the open end 18, in both the magazine gun magazine and the straight rectangular shaped magazine.

With the dart magazine 16 straight rectangular portion 23 and open end 18 extending and being received in the slot 14 of the launch apparatus 10, as seen in FIG. 3A, a pair of magazine sensor micro switches 43 and 45 are employed for detecting the presence and type of inserted magazine 16. The top micro switch 43 as illustrated in FIG. 3A functions both as a power switch to the electronic circuitry to the launch apparatus 10 and the micro switch 43 also detects when a when dart magazine 16 is inserted in order to detect magazine presence at the slot 14. The lower micro switch 45 is used to detect a type of inserted magazine 16 by a detecting a detent or notch 74 in the dart magazine 16 which indicates that the inserted magazine 16 is a 30 round magazine.

In accordance with the present invention the flow charts of FIGS. 11-14 illustrate loading logic for dart intake so as to control and monitor the darts supplied. Additionally LED light status, LEDs mounted on the launcher apparatus 10 not show, and the light indicators may be used to indicate a number of conditions. With reference to Loading Logic flow chart FIG. 11, a dart clip, drum or magazine capacity N and dart Count key is shown where: N= magazine/drum capacity; and Count=darts currently in the dart clip, drum or magazine, which are used prevent overfilling of the magazine receiving a series of darts loaded, and controlling operation of the stuffer mechanism having reciprocating stuffer structure for loading the darts into the dart magazine.

Also shown is a LED Status key is shown where: (1) Red=jam detected or jam door open; (2) Yellow=empty magazine; (3) Blinking Yellow=magazine full, and will turn Green below when accelerator activated launch motors 51 and 53 drive rotation of accelerator launch wheels 54 and 56 discussed below; finally indicating (4) Green=ready to shoot. A micro switch and/or a sensor limit stuffer home switch may be provided as an infrared sensor IR (infra-red) beam sensing with a check cycle to monitor the time it takes to fill the dart into the magazine and launch apparatus 10 conditions. Using the IR the launch apparatus 10 determines when the drum is empty and via a light color can give feed back to the user that the drum is empty (Solid Yellow). Using the IR the launch apparatus 10 determines when a dart is in position to be fired. Determining this can govern the driving of the pusher to only push when a dart is ready reducing the likelihood of jams. Via the light colors the launch apparatus 10 can let the user know when the system is ready (Green). Using the home switch for the pusher the launch apparatus 10 can determine when the pusher does not return home and assumes it has jammed and alert the user to the presence of a jam via the red color (Solid Red). If the jam door is open the firing is disabled until it is closed (Solid Red). As described earlier using the home switch for the suffer the launch apparatus 10 can monitor the time it takes to fill the clip and if not completed in a designated amount of time let the user know the drum/clip is in a full state via the lights (blinking yellow).

Loading Logic at 100 the Magazine/Drum inserted in blaster the launch apparatus 10 starting at step 100. At decision block 102 as discussed switches 43 and 45 detects the dart magazine 16 inserted at the slot 14 indicate if the inserted magazine is a 30 round magazine. If so, at step 104 the dart magazine capacity N=is set to 30 for the inserted magazine. At step 106, the decision block determines if the drum is empty. At step 108, the block Count=0 for darts currently in the magazine, if the drum is empty with LED=Yellow. At step 110, to drum 30 count known, the flow chart proceeds to FIG. 14 for Drum Logic with known count. At step 112, the decision block determines if the drum is full. At step 114, the block Count=30 for darts currently in the magazine where the drum is full with LED=Blinking Yellow, and then at step 110, to drum 30 count known, the flow chart proceeds to FIG. 14 for Drum Logic with known count. At step 116 where the dart Count=unknown, is neither empty nor full, then at step 118, to drum 30 count unknown, the flow chart proceeds to FIG. 13 for Drum Logic with unknown count. Where the dart magazine 16 inserted magazine is not a 30 round magazine, at step 120, the decision block determines if the magazine is full. If so, at step 122 the dart capacity N=is set to 1 for the inserted magazine, with Count=2 for darts currently in the magazine where the drum is full with LED=Blinking Yellow, setting mag-full flag as set, and then at step 126 for magazine logic where the dart magazine capacity N and the dart Count are unknown, but with the magazine full the flow chart proceeds to FIG. 12 for Magazine Logic. If the magazine is not full from step 120 the dart capacity N=is set to 0 for the inserted magazine, with Count=0 at step 124 for darts currently in the magazine where the drum is not full, and then at step 126 for magazine logic where the dart magazine capacity N and the dart Count is unknown, the flow chart proceeds to FIG. 12 for Magazine Logic.

Figure 12:
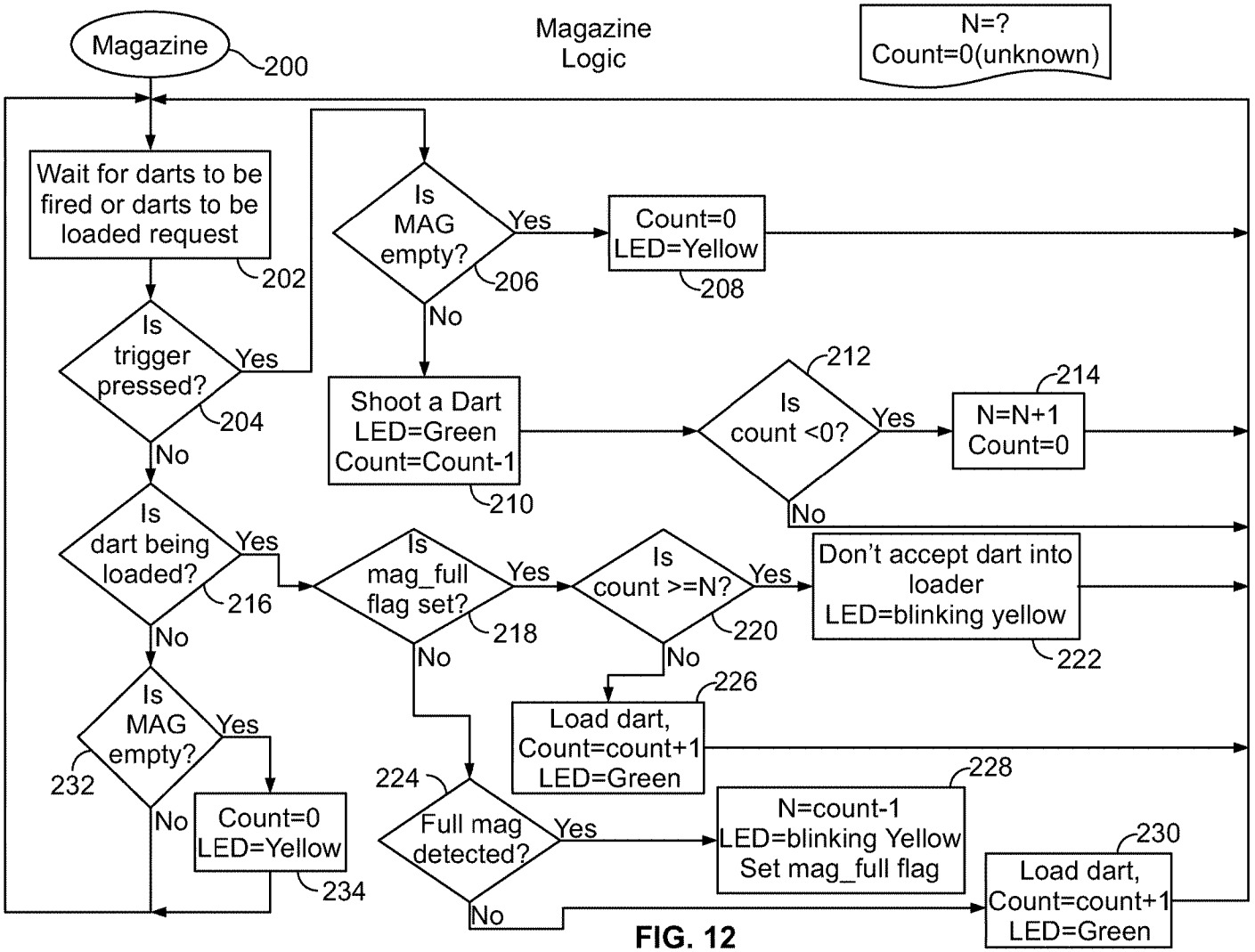

Turning to FIG. 12 for Magazine Logic, the magazine flow chart proceeds at Step 200 when the magazine is not full, dart capacity N=is set to 0 for the inserted magazine, with Count=0 and/or where the dart magazine capacity N and the dart Count is unknown, the flow chart proceeds from Step 200 Magazine Logic. At step 202, the flow chart proceeds to wait for darts to be fired or darts to be loaded request. At step 204, the flow chart proceeds for decision block: is trigger pressed? At step 206, the flow chart proceeds for decision block: is magazine empty? At step 208, the flow proceeds to set Count=0 and LED=Yellow. At step 210, the flow proceeds to Shoot a Dart, decrement and set Count=Count−1 and LED=Green. At 212, Is Count>0? At 214, increment N=N+1 and Count=0. At 216, Is dart being loaded? At 218, Is mag-full flag set? At 220, Is Count>=N? At 222, Don't accept dart into loader, and LED=blinking yellow. At 224, Is a full magazine detected? At 226, Load dart and increment Count=Count+1 and LED=Green. At 228, decrement N=Count−1 and LED=Blinking Yellow set mag-full flag. At 230, Load dart and increment Count=Count+1 and LED=Green. At 232, Is a magazine empty detected? At 234, Count=0, and LED=Yellow, with a return to step 202 where the flow chart waits for darts to be fired or darts to be loaded request.

Figure 13:
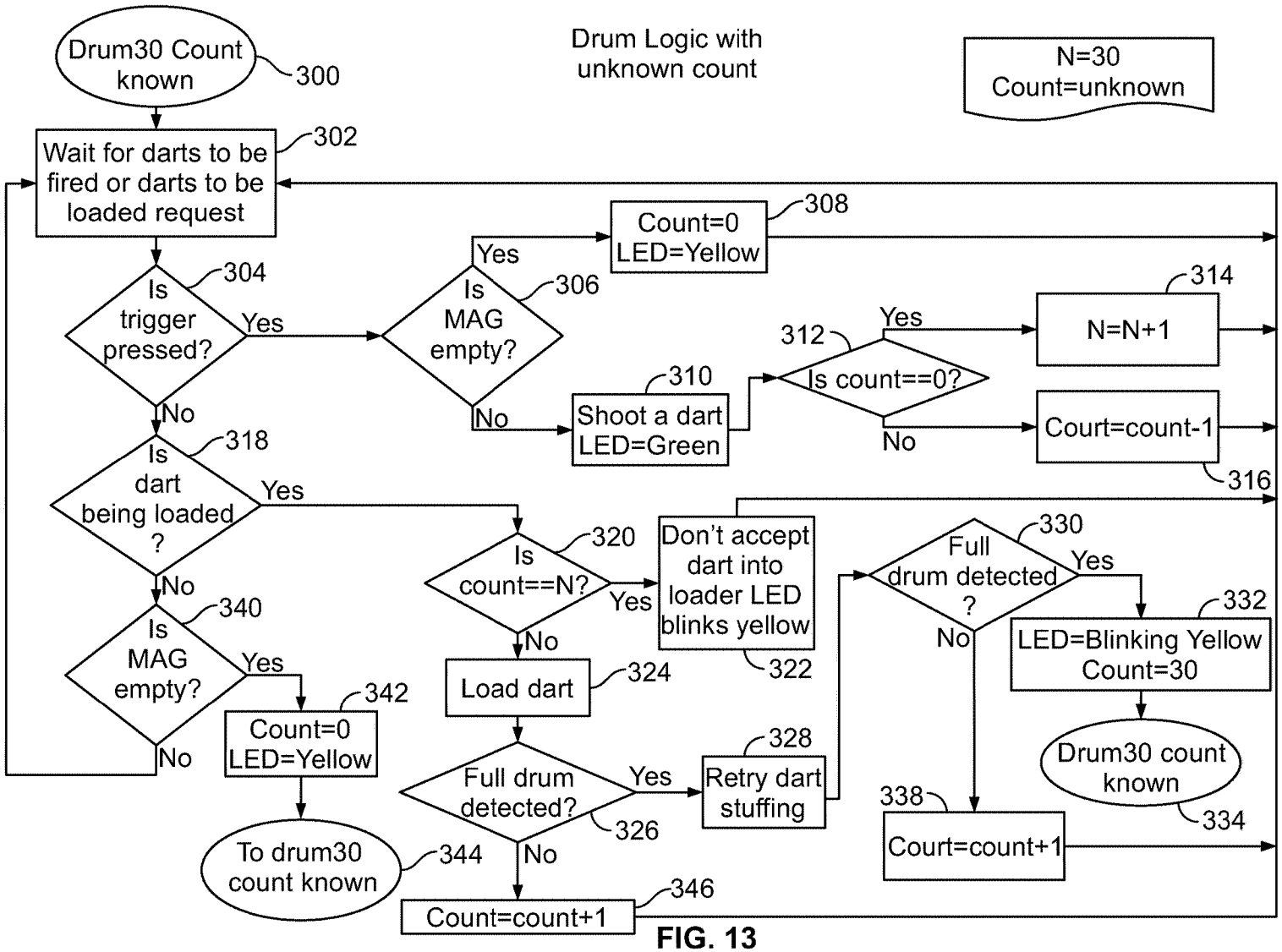

Turning to FIG. 13 where the dart Count=unknown, is neither empty nor full, with N=30 for drum 30 count unknown, the flow chart proceeds from step 300 for Drum Logic with N=30. At step 300 drum 30 count known, the flow chart proceeds at step 302, wait for darts to be fired or darts to be loaded request. At step 304, the flow chart proceeds for decision block: is trigger pressed? At step 306, the flow chart proceeds for decision block: is magazine empty? At step 308, the flow proceeds to set Count=0 and LED=Yellow. At step 310, the flow proceeds to Shoot a Dart, decrement and set Count=Count−1 and LED=Green. At 312, Is Count=0 Yes/No? At 314 step increment for N=N+1, and decrement at 316 Count=Count−1, with a return to step 302 where the flow chart waits for darts to be fired or darts to be loaded request. At 318, Is dart being loaded? At 320, Is magazine empty? At 322, Don't accept dart into loader, and LED=Blinking Yellow. At 324 Load dart, and with decision step 326 determine if Full drum magazine is detected? At step 328 Re-try dart stuffing, and with decision step 330 determine if Full drum magazine is detected? At 332, Count=30, and LED=Blinking Yellow. At 334, Drum 30 count known, Count=30 so don't accept dart into loader with a return to 300 and with step 338 increment Count=Count+1, and step 302 where the flow chart waits for darts to be fired or darts to be loaded request. At step 340, the flow chart proceeds for decision block: is magazine empty? At step 342, the flow proceeds to set Count=0 and LED=Yellow. At 344, Drum 30 count known, Count=30 so don't accept dart into loader and again return to 300 and with step 346 increment Count=Count+1, and step 302 where the flow chart waits for darts to be fired or darts to be loaded request.

Figure 14:
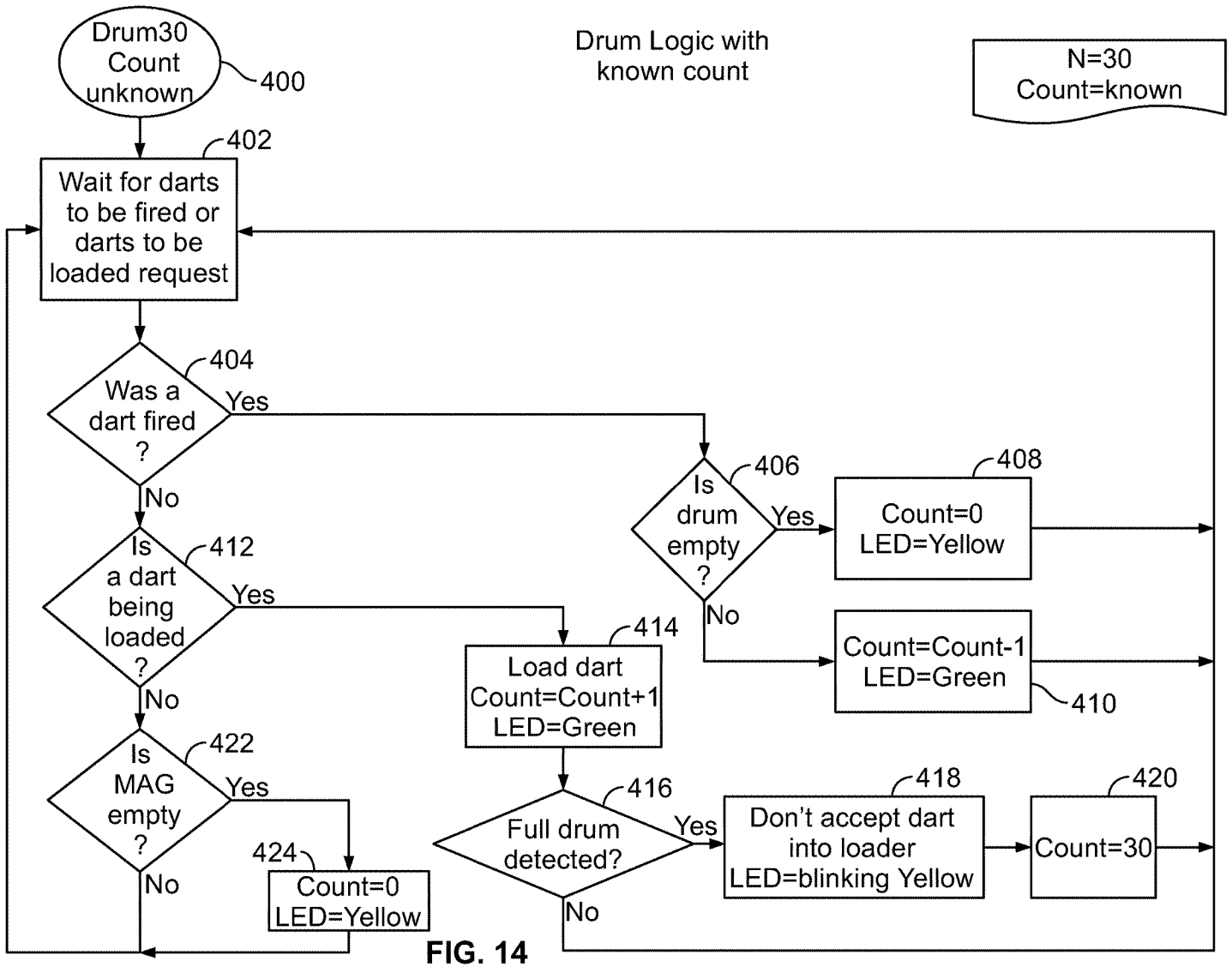

Turning to FIG. 14 for Drum Logic with known count the flow chart proceeds from step 400 drum 30 count unknown, then dart capacity N=is set to 30 with the dart Count is known. At step 402, the flow chart proceeds to wait for darts to be fired or darts to be loaded request. At step 404, Was a dart fired? At step 406 the flow proceeds for decision block: is magazine empty? At step 408, flow proceeds to set Count=0 and LED=Yellow. At step 410, the flow proceeds to Shoot a Dart, decrement and set Count=Count−1 and LED=Green. At 412, Is dart being loaded? At 414, Load dart and increment Count=Count+1 and LED=Green. At 416, Is a full magazine detected? At 418, Don't accept dart into loader, and LED=Blinking Yellow. At 420, Count=30, with a return to step 402 where the flow chart waits for darts to be fired or darts to be loaded request. At 422, Is a magazine empty detected? Where the decision block determines if magazine drum is empty, the Count=0 for darts currently in the magazine as empty with LED=Yellow, with a return to step 402 where the flow chart waits for darts to be fired or darts to be loaded request.

Figure 3D:
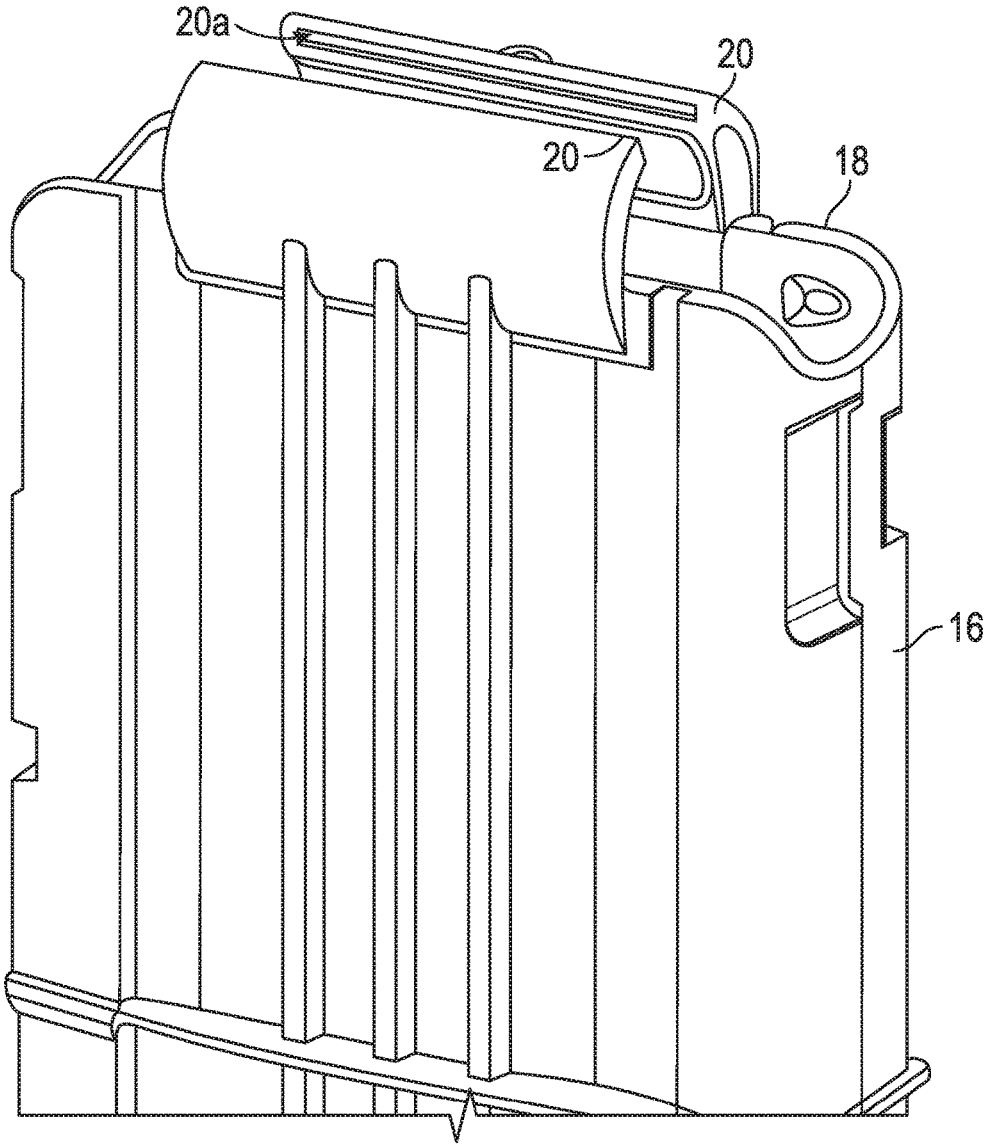
Figure 3E:
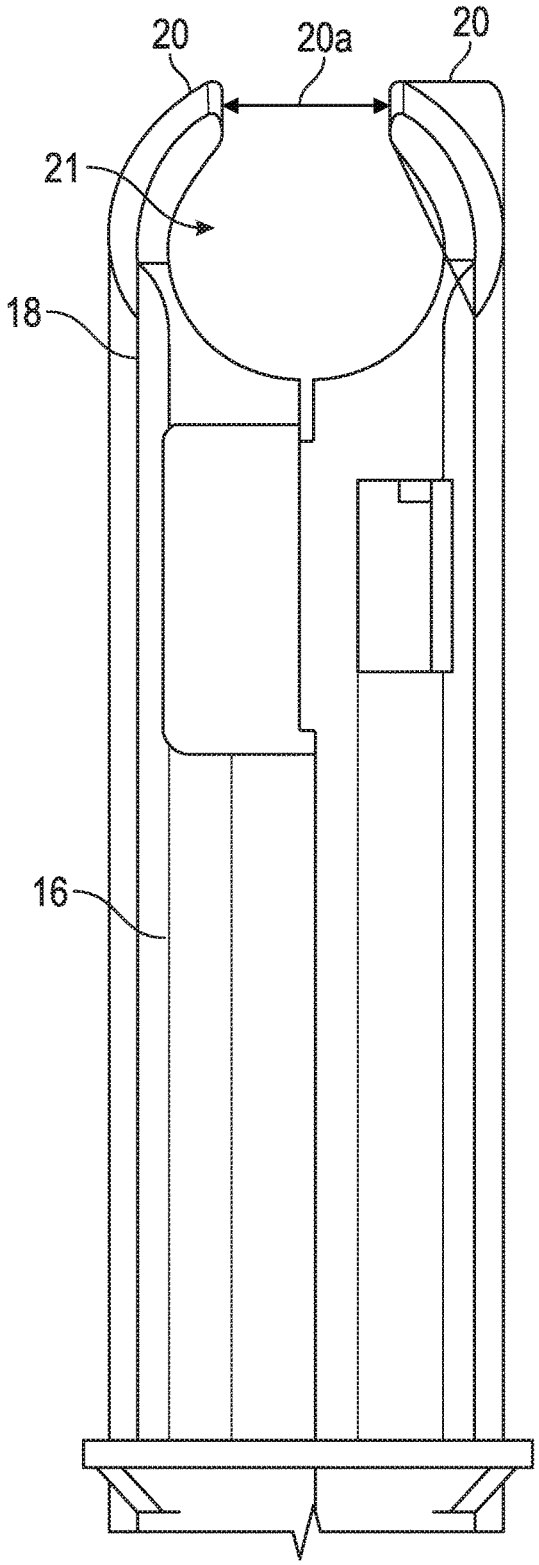
FIG. 3E is illustrating a side view of the retaining lips as they define an open chamber at the open end of the dart magazine clip.

Additionally, the open end 18 of the machine gun magazine, as seen in FIG. 3B, is essentially identical to the open end 18 of the entirely straight and rectangular magazine, as seen in FIG. 3C, and both the machine gun magazine and the rectangular magazine, as seen in FIGS. 3D and 3E, respectively, each include a pair of retaining lips 20 at the open end 18. Each retaining lip 20 extends from an opposite side of the open end 18 of the magazine, with the retaining lips slightly curving toward each other, as seen in FIGS. 3D and 3E. The generally C shaped retaining lips together define a retaining space or open compartment 21 for retaining an uppermost dart 17 in the magazine. The dart magazine 16 thus inserted into the slot 14 of the toy launch apparatus 10 of the housing assembly 12 has its open end 18 positioned upwardly therein.

The lips 20 do not touch each other as they extend and curve beyond the open end 18 leaving a gap 20*a* between distal ends of the two retaining lips 20. The uppermost dart 17 in the magazine slightly bulges through the gap 20*a* until the magazine is inserted into the housing assembly 12, where the feeding/dart funnel 24 urges the dart 17 from the retaining lips, as discussed in further detail below. The dart advancing mechanism 15 creates the force that bulges the uppermost dart 17 into the gap between the retaining lips 20. The dart advancing mechanism 15 advances the retained darts through the magazine and the retaining lips 20 prevent the dart advancing mechanism 15 from pushing the uppermost dart out of the open end of the magazine. The biased dart advancing mechanism thus urges darts in the dart magazine toward the open end of the dart magazine, the biased dart advancing mechanism in the dart magazine urging darts therein at the dart sidewall.

The dart advancing mechanism 15 can include a spring biased platform 22, as seen in FIG. 3C, secured to an end of the magazine 16 opposite the open end 18. The secured spring urges the platform toward the open end 18 and advances darts 17 loaded into the magazine clip toward the open end, as seen in FIG. 3C. The retaining lips 20, as seen in FIG. 3D, prevent the spring biased platform 22 from advancing the loaded/retained darts from the magazine until the magazine is inserted into the toy launch apparatus 10 and readied for launching, as discussed in more detail below.

The darts 17 are generally manufactured from a foam material. The dart tip 19 is coupled at the first end 17*a* of the dart 17 and a rear advancing surface 17*c* is included at the second end 17*b*. The dart tip 19 is generally manufactured from a flexible plastic material and the dart tip 19 is generally heavier in weight than the dart 17 (sidewall tubular body) which is manufactured from foam.

A continuous feeding/dart funnel 24, as seen in FIGS. 2-3A, is coupled to the housing assembly 12 adjacent the inserted magazine 16 and extends into the dart magazine at the open end 18 for releasing darts from the magazine and feeding darts into an energy generating mechanism without darts jamming up in the launcher. In use, a sensor limit intake detector switch 30 is used to detect the presence of an inserted dart, as seen in FIGS. 2-3A, and 7, is depressed by a user and activates the energy generating mechanism 32 which drives intake motors. The intake detector switch 30 is an electromechanical switch for detecting the at least one dart being manually fed into the dart funnel. In the present described embodiment, the intake energy generating mechanism 42 includes two opposed rotatable intake wheels, 26 and 28 which engage and advance darts therebetween coupled to an axle 32 and 34, respectively, with each, or gears driven for rotation about their axle 32 and 34 drive rotation of intake wheels 26 and 28, (or alternatively first and second gears) 26 and 28, respectively, are positioned in parallel relationship to one another respectively for creating a feeding intake force frictionally applied to the dart as the dart is engaged by wheel surfaces on each of the opposed rotatable intake wheels 26 and 28. This magazine loading mechanism is positioned in the housing 12 intermediate the funnel 24 and the dart retaining lips 20 at the open end 18 of the inserted magazine for receiving the at least one dart from the funnel for loading at the open end 18 of the inserted magazine between the dart retaining lips 18. The rotating wheels impart sufficient energy to the dart to draw the dart into the toy launch apparatus 10 through the feeding/dart funnel 24.

As seen in FIG. 2, motor 51 is contained within drive intake wheel 26 and intake motor 53 is contained within drive intake wheel 28, such that activated intake motor 51 drives rotation of intake wheel 26 and activated motor 53 drives rotation of wheel 28. The magazine loading mechanism employs intake energy generating mechanism with rotatable intake wheels to engage the at least one dart from the funnel for loading at the open end of the inserted magazine between the dart retaining lips. The intake energy generating mechanism uses the intake detector switch 30 for detecting at least one dart manually fed into the dart funnel 24. One or more gears of the gear train 36 ride on second axle 34 adjacent second intake wheel 28, driving rotation of second wheel 28 in a continuous fashion as long as motor 38 is activated drawing darts into the toy launch apparatus 10 integral with the continuous feeding/dart funnel 24, advancing the dart into the energy projecting mechanism.

Figure 4:
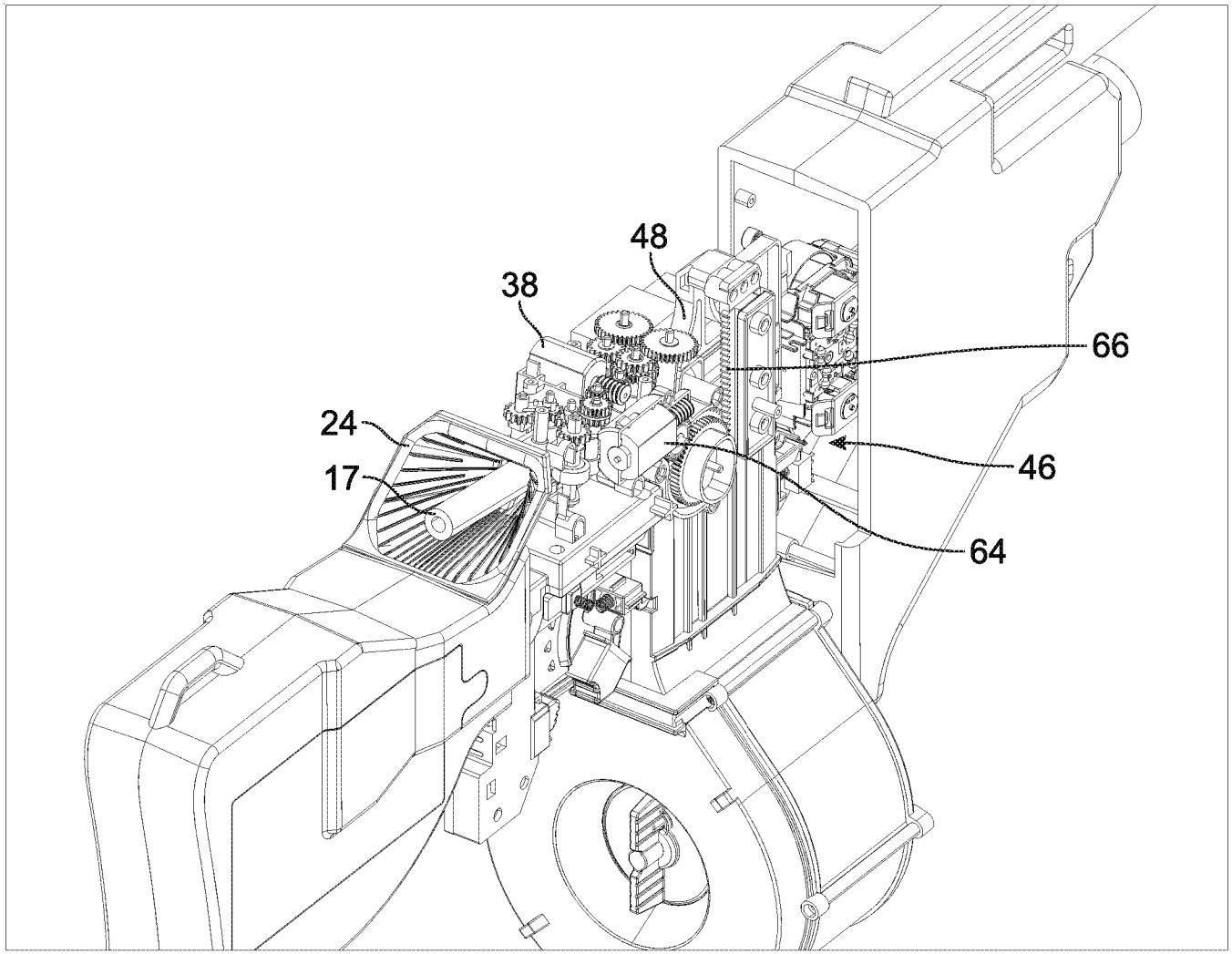
FIG. 4 shows a dart funnel for one or more serially manually fed darts into the funnel on the housing assembly exposed to show an internal magazine loading mechanism positioned in the housing intermediate the funnel and an inserted dart magazine thereunder in accordance with the present invention.

The feeding/dart funnel 24, as seen in FIGS. 3A and 5-7 provides a positioning and timing with a dart intake switch in funnel 24 until dart tip hits stuffer activation lever switch at 46 stuffer driver limit switch indicates the dart has traveled in and is positioned to be stuffed, then a stuffer activation switch, referenced at the right of reference numeral 46. Next to stuffer activation lever, the stuffer home IR switch checks cycle to monitor the time it takes to fill the dart into the magazine and launch apparatus 10 as discussed above in connection with the Loading Logic flow charts of FIGS. 11-14. The home switch will monitor the time the stuffer mechanism 48 is actively trying to load a dart. If the stuffer mechanism 48 takes more than a designated amount of time to get "home" the magazine is assumed to be full, also sensing for over-travel, so as to avoid overfilling based on the home check cycle indicating the magazine is filed or full magazine clip loading detection. As is discussed further in connection with the loading logic flow charts of FIGS. 11-14 below, once full the intake switch in funnel 24 is disabled to ensure no further darts are supplied, and prevent overfilling of the magazine. The feeding/dart funnel 24 is designed to reliably release the uppermost dart from the retaining lips of the inserted magazine and simultaneously time the advancement of the released dart into the energy generating mechanism. In the present described embodiment, the dart funnel 24 shown in FIG. 4 facilitates one or more serially manually fed darts into the funnel on the housing assembly exposed to show an internal magazine loading mechanism positioned in the housing intermediate the funnel and an inserted dart magazine thereunder. At the magazine loading mechanism the lever switch at 46 stuffer driver limit switch operates with a stuffer mechanism 48 limiting operation under a dart count using the switch 46 as each dart tip is detected. As discussed the switch 46 is coupled to the housing above the inserted magazine 16, with the stuffer mechanism 48 for penetrating the dart retaining lips 20 to stuff the at least one dart 17 at the dart sidewall from between the dart retaining lips for loading into the magazine. A stuffer motor 64 operates a reciprocating structure 66 through rack gears structures to reciprocate stuffer mechanism 48. Accordingly, the inserted magazine 16 receives a series of darts 17 loaded into the dart magazine 16.

The pusher element 40 advances the darts from the magazine 16 with the energy generating mechanism timed for advancing the dart 17 into the dart launching mechanism forward the inserted magazine, and advances the darts only when the uppermost dart is correctly positioned for launching from the launch apparatus thus preventing the darts from being mis-fed into the energy generating mechanism and jamming up in the launcher. The pusher 40 is rearward the inserted magazine for pushing the dart rear advancing surface from between the dart retaining lips to advance the at least one dart into the forward launching mechanism. In the present described embodiment, the pusher element 40 feeding mechanism actively push darts into an adjacent launching mechanism via an elongated arm biased into contact with a stack of darts lined up adjacent a drive wheel. The elongated arm biases the pusher element 40 into contact with the upper most dart of the stack and urges the lower most dart into the barrel adjacent the drive wheel urges the uppermost dart 17 into a releasing position while at the same time rotating protrusion elements which simultaneously time the advancement of the correctly positioned released darts.

Darts 17 advance through the magazine as the advancing force from the dart advancing mechanism 15 is exerted against the darts loaded in the magazine. The energy generating mechanism is operatively in communication with each of the magazine loading, stuffer, and dart launching mechanisms. Darts pop up one by one into the retaining space or open compartment 21 between the retaining lips 20 before being advanced into the path of the energy generating mechanism. As the darts pop up into the open compartment 21, the heavier dart tip 19 is slightly tilted toward the magazine and lags behind the foam dart (body) when advanced into the compartment 21. If the dart is advanced or travels from the magazine while still in this slightly tilted position, the dart will not correctly feed into the energy generating mechanism and will jam up inside the launcher. This is especially likely to occur when darts are rapidly advanced into the energy generating mechanism from the dart magazine for rapid fire launching of darts from the toy.

Figure 5:
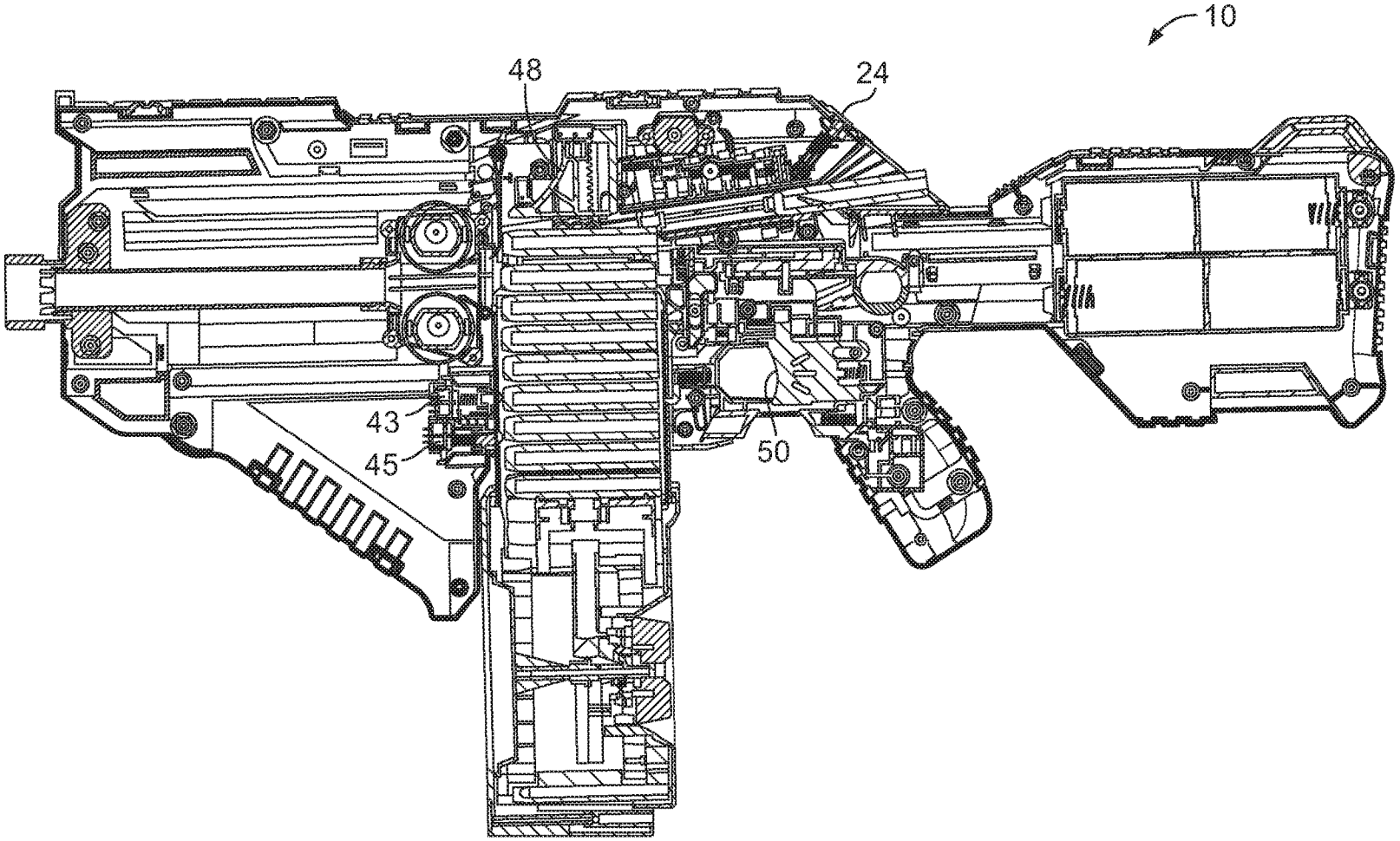
FIG. 5 illustrates a cross-section view of a toy launch apparatus with a dart magazine inserted into the housing assembly positioned with the launch apparatus including dart magazine loading, projectile launching structures and related mechanisms in the housing thereof.
Figure 6:
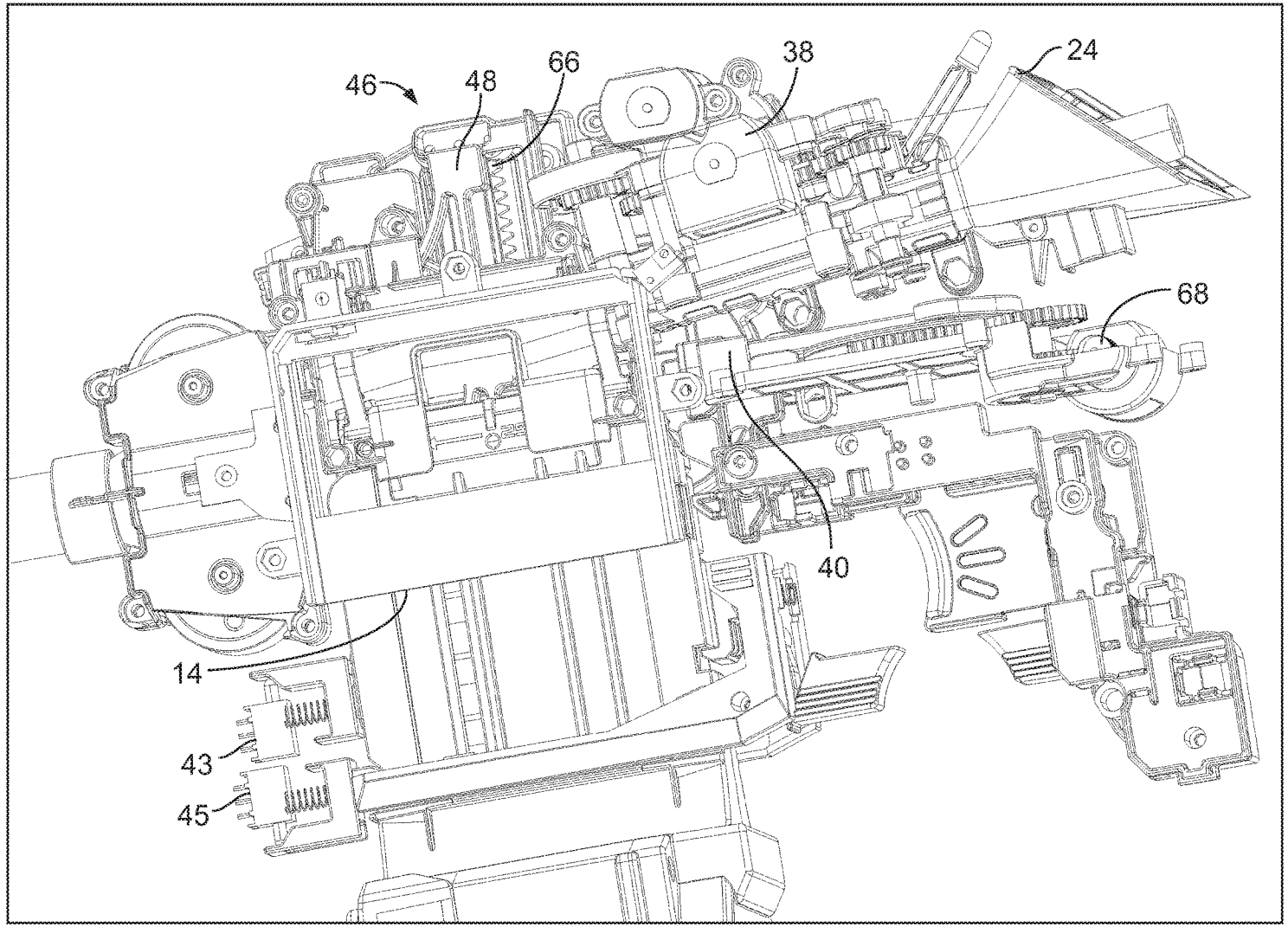
FIGS. 6 and 7 illustrate the feeding/magazine storage structures for dart magazine loading and following structure for firing projectiles from the magazine to the forward launching mechanism in accordance with the present invention.
Figure 7:
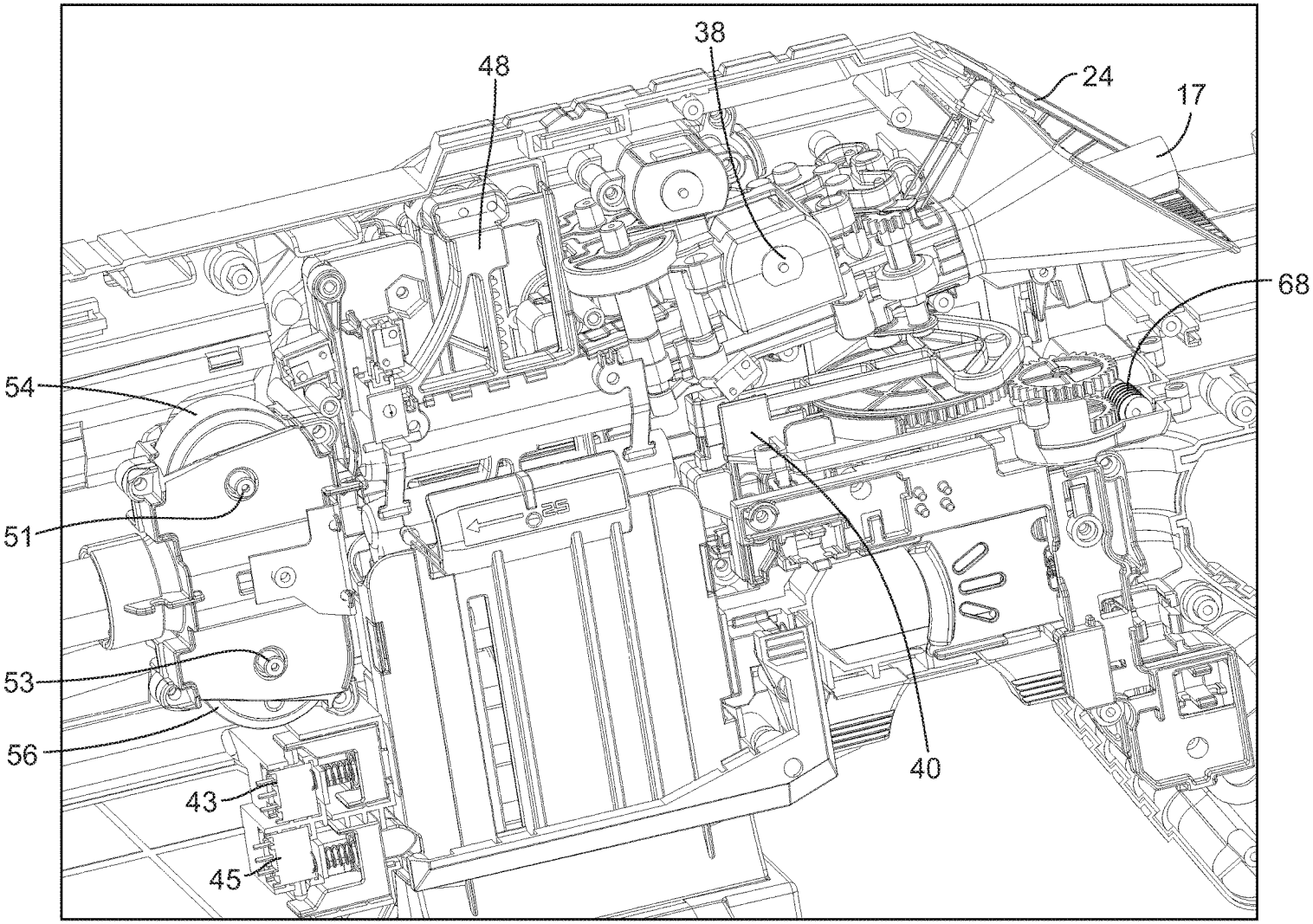

FIG. 5 shows a cross-section view of a toy launch apparatus 10 with a dart magazine 16 inserted into the housing assembly 12 positioned with the launch apparatus 10 and including dart magazine loading, projectile launching structures and related mechanisms in the housing 12 thereof. FIGS. 6 and 7 has the feeding/magazine storage structures for dart magazine loading and following structure for firing projectiles from the magazine 16, where the magazine loading mechanism 46 is positioned in the housing intermediate the funnel 24 and the inserted dart magazine 16 for receiving darts 17 to the magazine open end described above. with the dart launching mechanism in the housing forward the inserted magazine, and using a pusher element 40 rearward the inserted magazine 16 for pushing the at least one dart 17 at its rear advancing surface 17*c* from between the dart retaining lips 20 to advance the at least one dart 17 into the forward launching mechanism. Such feeding/anti-jamming mechanisms provide reliable positioning and timing of darts advanced from the magazine to the feeding/anti-jamming mechanism, eliminating darts misfiring from the toy launch apparatus. The feeding/anti-jamming mechanism is automatically designed to wait until darts are correctly positioned before feeding the darts into the energy generating mechanism, while at the same time continuously running the mechanism. The reciprocating pusher element 40 is uniquely designed to both run continuously to urge the uppermost dart to a releasing position, and also essentially wait to feed darts into the energy generating mechanism until the uppermost dart in the magazine is positioned.

The pusher element 40 advances the dart 17 at its rear advancing surface 17*c* without prematurely advancing it into the energy generating mechanism, with the pusher element 40 advancing a dart 17 residing between the dart retaining lips 20 of the magazine 16, advancing the dart away from the lips 20 at the foam dart body 17 with the forward dart tip 19 for advancement into the energy generating mechanism. Additionally the pusher element 40 extends to advance the positioned the dart 17 from the rear advancing surface 17*c* accessible to the pusher element 40. With the dart 17 correctly positioned, the pusher element 40 will engage the rear advancing surface 17*c* of the dart to push and advance the dart into the energy generating mechanism. The simultaneous positioning of each uppermost dart by the pusher element 40, with the correct contact timing with the rear contacting surface 17*c* of the positioned dart, advances each uppermost dart from the magazine in a rapid fire fashion without jamming darts in the toy launcher apparatus 10.

In use, a first trigger 50, as seen in FIGS. 1-2, is depressed by a user and activates both launch motors 51 and 53 which drive the energy generating mechanism 52. In the present described embodiment, the energy generating mechanism 52 includes two opposed rotatable accelerator launch wheels, 54 and 56 which engage and advanced darts there between.

Launch motors 51 and 53 drive rotation of launch wheels 54 and 56, respectively, creating a launching force frictionally applied to the dart as the dart engages a wheel surface on each of the opposed rotatable wheels. The rotating wheels impart sufficient energy to the dart to launch the dart from the toy launch apparatus. As seen in FIG. 2, launch motor 51 is contained within drive launch wheel 54 and launch motor 53 is contained within drive launch wheel 56, such that activated launch motor 51 drives rotation of launch wheel 54 and activated launch motor 53 drives rotation of launch wheel 56.

Additionally, the user depresses a second trigger 58, as seen in FIG. 1, which activates a second launch motor 38 which rotates the feeding/dart funnel 24. The second launch motor 38 is disposed within the housing 12 and positioned behind a part of the housing, as seen in FIG. 2. Reciprocating pusher element 40 about wheels 26 and 28. The pusher element 40 is advanced into the inserted magazine and with the pusher element 40 of the pusher element gliding along the uppermost dart residing in compartment 21 and urging the uppermost dart away from contact with the retaining lips 20 and into a releasing position. Continuous reciprocation of protrusion elements 40 into contact with the now accessible rear advancing surface 17*c* of the leveled dart in the releasing position and advances the dart into the energy generating mechanism, which fires the dart through an exit 62 in a barrel 60 of the toy launch apparatus.

Figure 8:
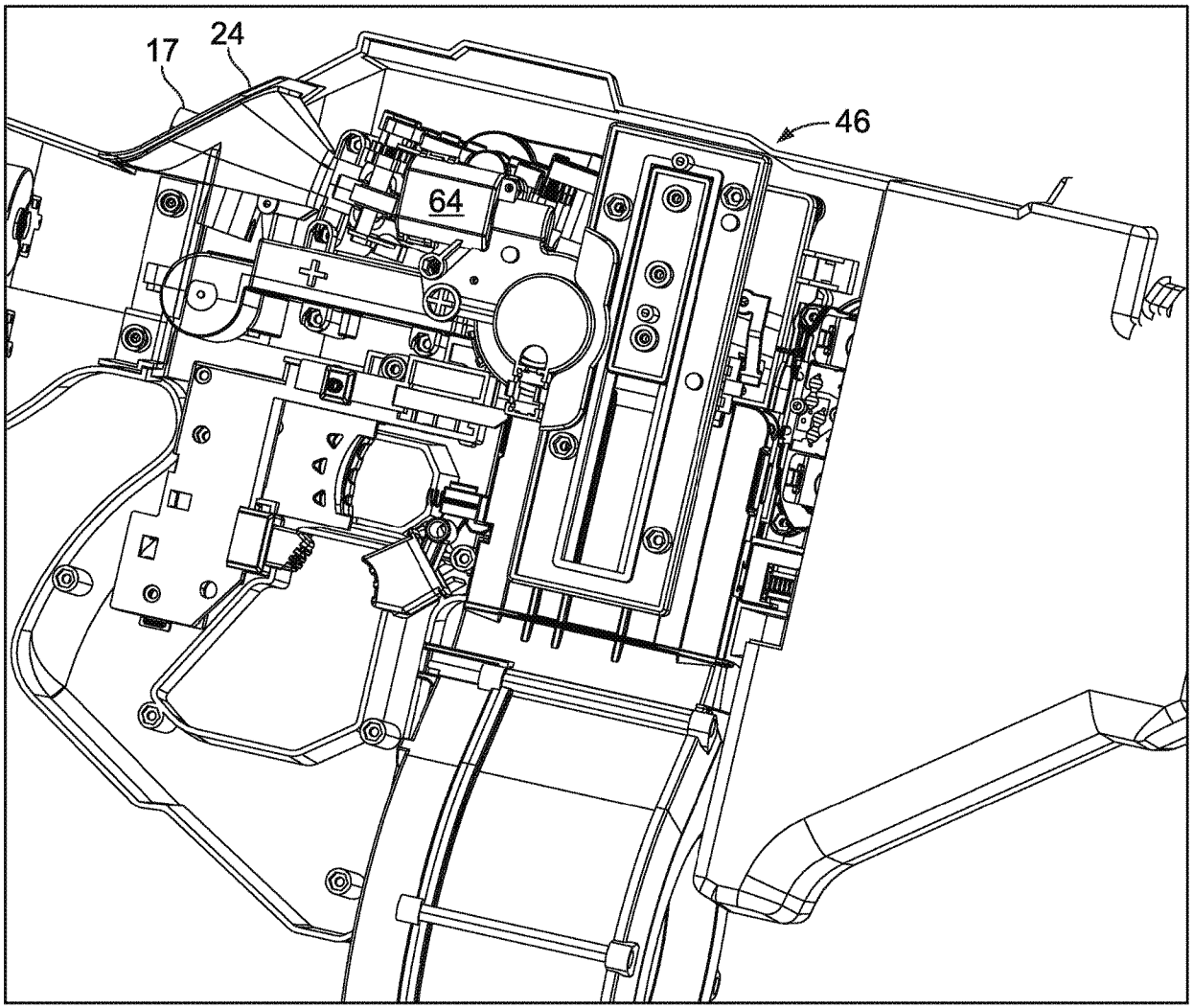
FIGS. 8, 9 and 10 illustrate dart loading employing the internal magazine loading mechanism positioned in the housing where a stuffer mechanism is coupled to the housing above the inserted magazine for penetrating into the magazine.
Figure 9:
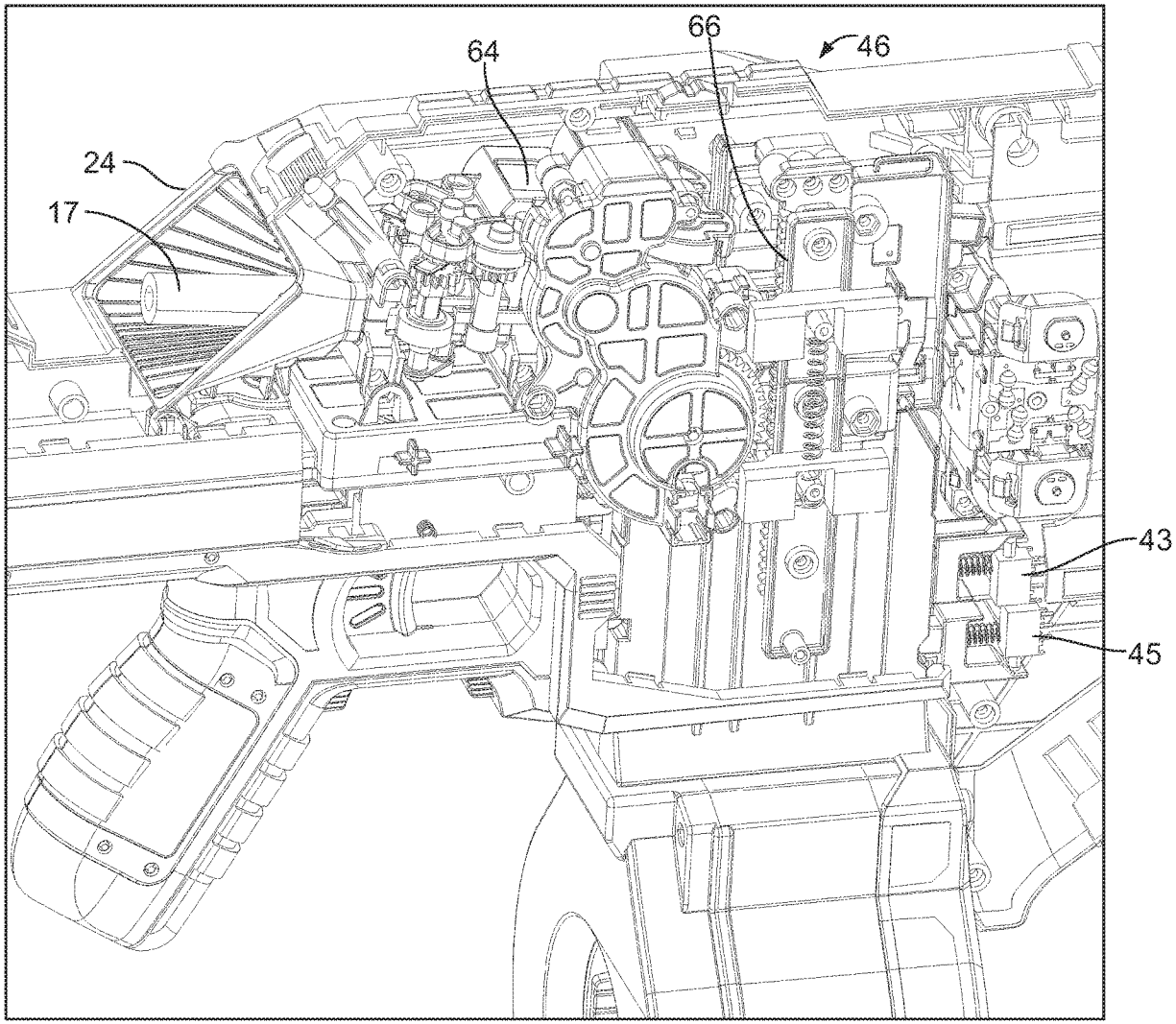
Figure 10:
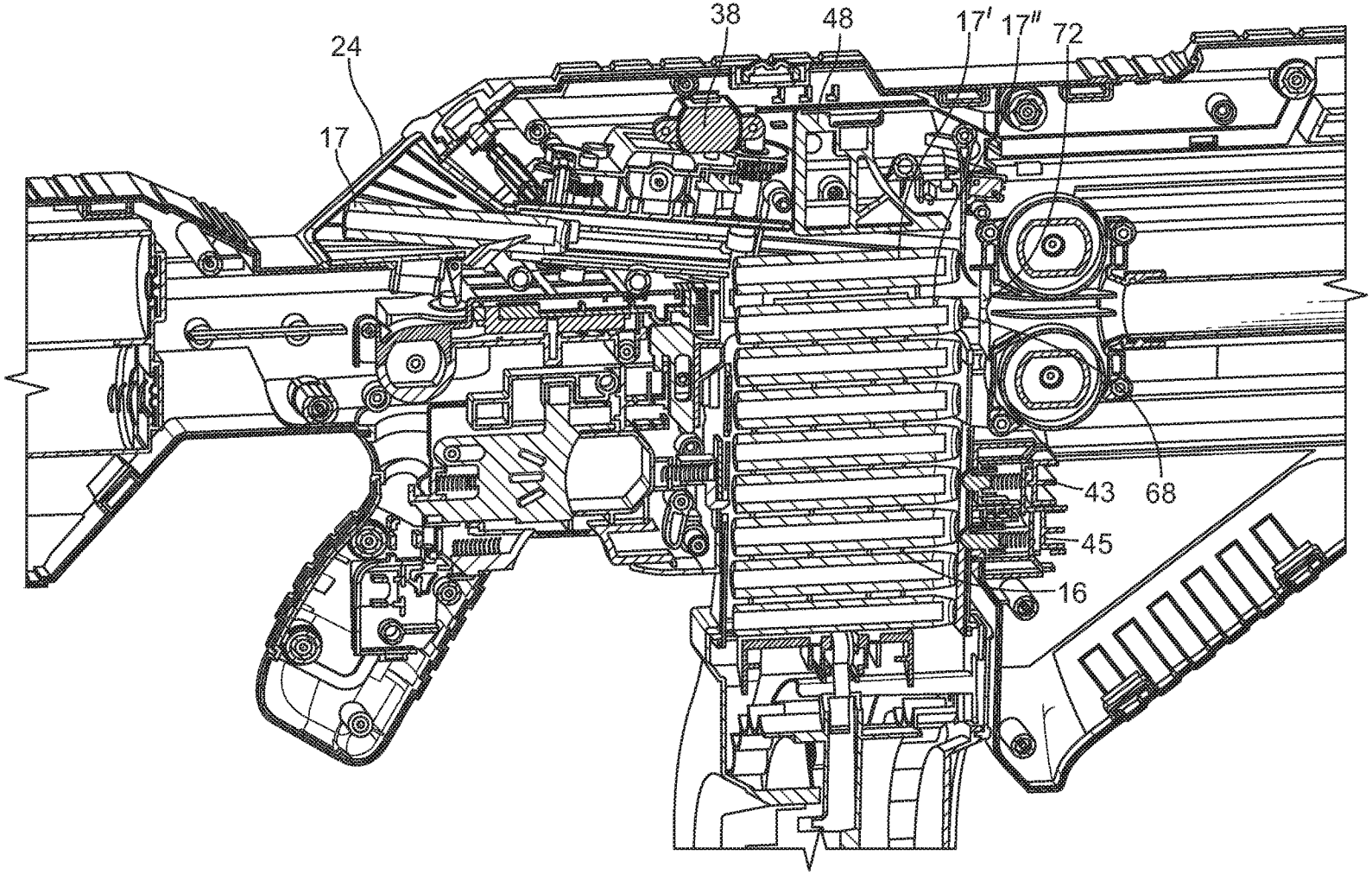
Figure 11:
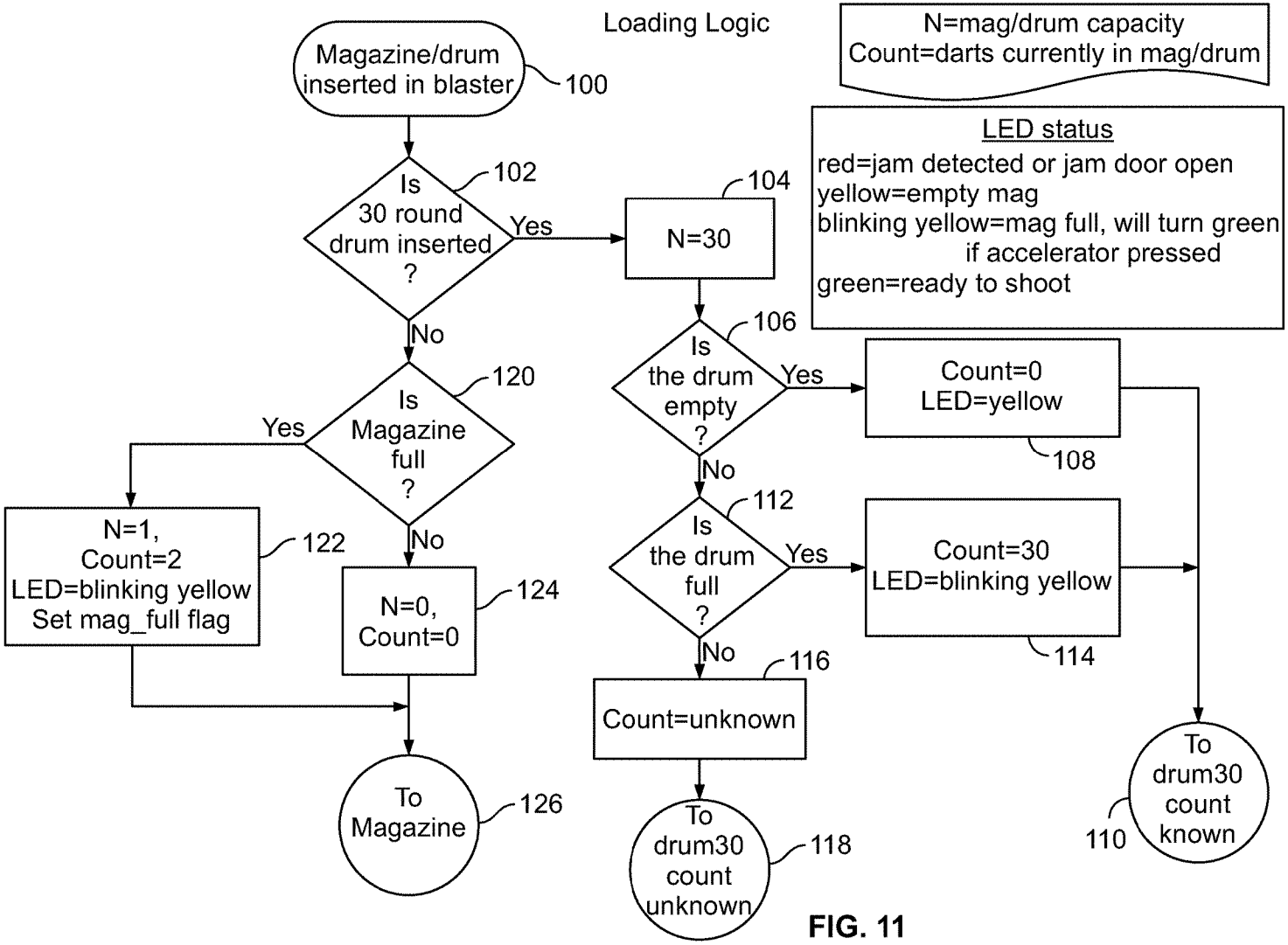
FIGS. 11-14 show loading logic flow charts for dart intake so as to control and monitor the darts supplied, and prevent overfilling of the magazine receiving a series of darts loaded, and controlling operation of the stuffer mechanism having reciprocating stuffer structure for loading the darts into the dart magazine in accordance with the present invention.

FIGS. 8, 9 and 10 show the dart loading employing the internal magazine loading mechanism 46 positioned in the housing where the magazine loading mechanism with the dart retaining lips 20 at the open end of the inserted magazine receives at least one dart for loading at the open end of the inserted magazine between the dart retaining lips 20, and a stuffer mechanism 48 is coupled to the housing 12 above the inserted magazine 16 for penetrating the dart retaining lips 16 to stuff the at least one dart 17 at the dart sidewall from between the dart retaining lips 20 for loading into the magazine 16, the inserted magazine 16 thusly receiving a series of darts 17 loaded into the dart magazine, with the inserted dart magazine thereunder. The reciprocating stuffer structure 66 is provided including rack gears structures with stuffer motor 64 operable to reciprocate stuffer mechanism 48 up and down to stuff the darts 17 between and into the dart retaining lips 20 for serially loading into the magazine 16, receiving a series of darts 17 loaded, with the stuffer mechanism 48 with the reciprocating actions for loading the darts 17'/17" as shown in FIG. 10 into the dart magazine 16.

A stuffer sensor limit micro switch 68 is employed for detecting at least one dart 17 at the inserted magazine 16 between the dart retaining lips to limit operation of the stuffer motor, the stuffer sensor limit switch 68 is provided as a limit micro switch, at the forward tip 19 of the dart 17 resting at the open end 18 of the magazine 16 between the dart retaining lips 20 identifies the ready to fire position. There is a check cycle which will monitor the time it takes to fill the dart into the magazine. Once full the intake switch will be disabled and this will prevent overfilling of the magazine. In an alternate embodiment an infrared sensor may be used for over-travel or full magazine clip loading detection to ensure, sensing of the forward tip 19 for the ready to fire position. The forgoing will monitor to ensure that there is a dart in place before the pusher is allowed to move forward. The intent of this feature is to reduce jamming occurrences and will also monitor to determine when the launch apparatus 10 is out of darts, facilitating a dart status/feeding/anti-jamming mechanism for feedback avoiding over filled and darts side by side. A second limit switch 70 is disposed within the slot 14 for capturing the inserted dart magazine is designed to sense and operate as closed/inactivated when a dart magazine is inserted into slot 14 allowing power to launch motor 38 and switch 70 is open/activated to cut off power to launch motor 38 when dart magazine 16 is removed from slot 14.

A soft barrier 72 is disposed at the housing 12 between the energy generating mechanism 52 and the feeding/dart funnel 24 in the pathway the dart 17 travels from the dart magazine to the energy generating mechanism, as a safety mechanism. The soft barrier 72 is manufactured from a silicone material with a perforated opening and is supported by a frame, however, it is also contemplated that the soft barrier can be manufactured from other materials such as plastic which is flexible enough for a dart to penetrate a perforated opening, but rigid enough to prevent unintended objects from entering the energy generating mechanism. The soft barrier 72 provides just enough resistance to prevent a projectiles less than two inches in length from getting into the energy generating mechanism. Object less that two inches in length could be a choking hazard and are undesirable projectiles to be fired from a toy launch apparatus. Also, the soft barrier 72 may prevent unintended and improvised projectiles from getting into the energy generating mechanism and being fired from the toy launch apparatus.

Additionally, in the present described embodiment, it is desirable keep the distance between the axle 32 of the first gear 26 and the entrance into the energy generating mechanism to 51 mm or more, as a safety precaution to keep small projectiles (typically less than two inches) out of the energy generating mechanism and fired from the toy launch apparatus. Projectiles less than 51 mm will not be long enough to stretch the gap between the feeding/anti-jamming mechanism and the energy generating mechanism, and will fall to the interior of the housing 12 without ever being fired from the toy launch apparatus.

While a particular embodiment of the present invention has been shown and described, it will be obvious to those skilled in the art that changes and modifications may be made without departing form the invention in its broader aspects. Therefore, the aim in the appended claims is to cover all such changes and modifications as fall within the true spirit and scope to the invention. The matter set forth in the foregoing description and accompanying drawings is offered by way of illustration only and not as a limitation. The actual scope to the invention is intended to be defined on the following claims when viewed in their proper perspective based on the prior art.

What is claimed is:

1. A dart launch apparatus, comprising:

a housing assembly;

a dart magazine inserted into the housing assembly, the inserted magazine having an open end including dart retaining lips at the open end;

a biased dart advancing mechanism urging darts in the dart magazine toward the open end of the dart magazine, each dart having a sidewall, a forward tip and a rear advancing surface, the biased dart advancing mechanism in the dart magazine urging darts therein at the dart sidewall;

a dart funnel on the housing assembly for at least one dart to be fed into the funnel;

a magazine loading mechanism positioned in the housing intermediate the funnel and the dart retaining lips at the open end of the inserted magazine for receiving the at least one dart from the funnel for loading at the open end of the inserted magazine between the dart retaining lips;

a stuffer mechanism coupled to the housing above the inserted magazine for penetrating the dart retaining lips to stuff the at least one dart at the dart sidewall from between the dart retaining lips for loading into the magazine, the inserted magazine receiving a series of darts loaded into the dart magazine;

a dart launching mechanism in the housing forward the inserted magazine;

a pusher rearward the inserted magazine for pushing the at least one dart at the rear advancing surface from between the dart retaining lips to advance the at least one dart into the forward launching mechanism; and at least one energy generating mechanism in communication with each of the magazine loading, stuffer, and dart launching mechanisms.

2. The dart launch apparatus recited in claim 1, wherein the magazine loading mechanism comprises an intake energy generating mechanism with rotatable intake wheels to engage the at least one dart from the funnel for loading at the open end of the inserted magazine between the dart retaining lips.

3. The dart launch apparatus recited in claim 2, wherein the intake energy generating mechanism comprises an intake motor driving the rotatable intake wheels.

4. The dart launch apparatus recited in claim 3 wherein the intake energy generating mechanism comprises an intake detector switch detecting at least one dart manually fed into the dart funnel.

5. The dart launch apparatus recited in claim 4 wherein the intake detector switch is an electromechanical switch for detecting the at least one dart being manually fed into the dart funnel.

6. The dart launch apparatus recited in claim 3 wherein the intake motor drives rotation of at least one of first and second intake wheels.

7. The dart launch apparatus recited in claim 1 wherein the dart launching mechanism comprises a launch motor at the housing for driving rotation of at least one of first and second launch wheels.

8. The dart launch apparatus recited in claim 1 wherein the stuffer mechanism comprises reciprocating stuffer structure advancing at the dart sidewall between the dart retaining lips for loading the series of darts into the dart magazine.

9. The dart launch apparatus recited in claim 8 wherein the stuffer mechanism comprises a stuffer motor at the housing for reciprocating the reciprocating stuffer structure of the stuffer mechanism for loading the series of darts into the dart magazine.

10. The dart launch apparatus recited in claim 9 wherein the stuffer mechanism comprises a stuffer sensor limit switch sensing at least one dart at the inserted magazine between the dart retaining lips to limit operation of the stuffer motor.

11. The dart launch apparatus recited in claim 10 wherein the stuffer sensor limit switch comprises a limit micro switch.

12. The dart launch apparatus recited in claim 7 wherein the pusher mechanism comprises reciprocating pusher structure advancing from the rear advancing surface for advancing at least one of the dart into the launch wheels of the dart launching mechanism.

13. The dart launch apparatus recited in claim 12 wherein the pusher mechanism comprises a pusher motor at the housing for reciprocating the reciprocating pusher structure of the pusher mechanism for launching a series of darts from the dart magazine.

14. A dart launch apparatus, comprising:

a housing assembly;

a dart magazine inserted into the housing assembly, the inserted magazine having an open end including dart retaining lips at the open end;

a biased dart advancing mechanism urging darts in the dart magazine toward the open end of the dart magazine, each dart having a sidewall, a forward tip and a rear advancing surface, the biased dart advancing mechanism in the dart magazine urging darts therein at the dart sidewall;

a dart funnel on the housing assembly for at least one dart to be fed into the funnel;

a magazine loading mechanism positioned in the housing intermediate the funnel and the dart retaining lips at the open end of the inserted magazine for receiving the at least one dart from the funnel for loading at the open end of the inserted magazine between the dart retaining lips, wherein the magazine loading mechanism comprises an intake energy generating mechanism with rotatable intake wheels to engage the at least one dart from the funnel for loading at the open end of the inserted magazine between the dart retaining lips;

a stuffer mechanism coupled to the housing above the inserted magazine for penetrating the dart retaining lips to stuff the at least one dart at the dart sidewall from between the dart retaining lips for loading into the magazine, the inserted magazine receiving a series of darts loaded into the dart magazine, wherein the stuffer mechanism comprises reciprocating stuffer structure advancing at the dart sidewall between the dart retaining lips for loading the series of darts into the dart magazine;

a dart launching mechanism in the housing forward the inserted magazine; and a pusher rearward the inserted magazine for pushing the at least one dart at the rear advancing surface from between the dart retaining lips to advance the at least one dart into the forward launching mechanism, wherein the pusher mechanism comprises reciprocating pusher structure advancing from the rear advancing surface into the launch wheels of the dart launching mechanism.

15. The dart launch apparatus recited in claim 14 comprising at least one energy generating mechanism in communication with each of the magazine loading, stuffer, and dart launching mechanisms, further comprising:

an intake motor driving at least one of the rotatable intake wheels of the intake energy generating mechanism;

a stuffer motor at the housing for reciprocating the reciprocating stuffer structure of the stuffer mechanism for loading the series of darts into the dart magazine;

a pusher motor at the housing for reciprocating the reciprocating pusher structure of the pusher mechanism for launching a series of darts from the dart magazine; and a launch motor at the housing for driving rotation of at least one of first and second launch wheels, the energy generating mechanism coordinating each of the magazine loading, stuffer, and dart launching mechanisms to receive and launch the series of darts.

16. The dart launch apparatus recited in claim 15 wherein the intake energy generating mechanism comprises an intake detector switch detecting at least one dart manually fed into the dart funnel, the intake detector switch detecting the at least one dart being manually fed into the dart funnel.

17. The dart launch apparatus recited in claim 16 wherein the stuffer mechanism comprises a stuffer sensor limit switch sensing at least one dart at the inserted magazine between the dart retaining lips to limit operation of the stuffer motor.

18. A dart launch method, comprising:

inserting an open end of a dart magazine with the dart magazine open end including dart retaining lips at the open end inserted into a housing assembly and having a dart funnel on the housing assembly for at least one dart to be fed into the funnel, each dart including having a sidewall, a forward tip and a rear advancing surface;

positioning a magazine loading mechanism in the housing intermediate the funnel and the dart retaining lips at the open end of the inserted magazine for receiving the at least one dart from the funnel for loading at the open end of the inserted magazine between the dart retaining lips, wherein the magazine loading mechanism comprises an intake energy generating mechanism with rotatable intake wheels to engage the at least one dart from the funnel for loading at the open end of the inserted magazine between the dart retaining lips;

providing a stuffer mechanism coupled to the housing above the inserted magazine for penetrating the dart retaining lips to stuff the at least one dart at the dart sidewall from between the dart retaining lips for loading into the magazine;

biasing darts in the dart magazine toward the open end of the dart magazine with a biased dart advancing mechanism in the dart magazine urging darts therein at the dart sidewall;

positioning a dart launching mechanism in the housing forward the inserted magazine; and positioning a pusher rearward the inserted magazine for pushing the at least one dart at the rear advancing surface from between the dart retaining lips to advance the at least one dart into the forward launching mechanism.

19. The dart launch method recited in claim 18, wherein the stuffer mechanism providing step comprises reciprocating the stuffer structure for advancing at the dart sidewall between the dart retaining lips for loading the series of darts into the dart magazine, the inserted magazine receiving a series of darts loaded into the dart magazine.

20. The dart launch method recited in claim 19 providing at least one energy generating mechanism in communication with each of the provided magazine loading, stuffer, and dart launching, further comprising the steps of:

providing an intake motor driving at least one of the rotatable intake wheels of the intake energy generating mechanism;

providing a stuffer motor at the housing for reciprocating the reciprocating stuffer structure of the stuffer mechanism for loading the series of darts into the dart magazine;

providing a pusher motor at the housing for reciprocating the reciprocating pusher structure of the pusher mechanism for launching a series of darts from the dart magazine; and providing a launch motor at the housing for driving rotation of at least one of first and second launch wheels, the energy generating mechanism coordinating each of the magazine loading, stuffer, and dart launching mechanisms to receive and launch the series of darts.

* * * * *